US008152030B2

(12) United States Patent
Coroneos

(10) Patent No.: US 8,152,030 B2
(45) Date of Patent: Apr. 10, 2012

(54) VALVE WRENCH ASSEMBLY KIT FOR RESTORING PURPOSED FUNCTION TO A COMPROMISED AEROSOL CONTAINER

(76) Inventor: Donald L. Coroneos, Waukegan, IL (US)

( * ) Notice: Subject to any disclaimer, the term of this patent is extended or adjusted under 35 U.S.C. 154(b) by 0 days.

(21) Appl. No.: 13/199,185

(22) Filed: Aug. 22, 2011

(65) Prior Publication Data

US 2011/0303705 A1 Dec. 15, 2011

Related U.S. Application Data

(63) Continuation-in-part of application No. 12/460,856, filed on Jul. 24, 2009, now abandoned.

(51) Int. Cl.
*B65D 83/00* (2006.01)

(52) U.S. Cl. ..... 222/402.13; 137/322

(58) Field of Classification Search ..... 222/402.13, 222/402.1, 402.25, 402.24, 394; 137/614.04–614.06, 137/322, 315.27, 315.28; 251/339
See application file for complete search history.

(56) References Cited

U.S. PATENT DOCUMENTS

| | | | | | |
|---|---|---|---|---|---|
| 2,530,583 | A | * | 11/1950 | Nurkiewicz | 169/75 |
| 3,187,962 | A | | 6/1965 | Meshberg | |
| 3,428,224 | A | | 2/1969 | Eberhardt et al. | |
| 3,635,379 | A | | 1/1972 | Angele | |
| 3,638,840 | A | | 2/1972 | Ishida | |
| 3,900,139 | A | | 8/1975 | Myers | |
| 4,211,347 | A | | 7/1980 | Milderm | |
| 4,228,933 | A | | 10/1980 | Elson | |
| 4,469,252 | A | | 9/1984 | Obrist | |
| 4,911,336 | A | | 3/1990 | Blake | |
| 4,971,224 | A | | 11/1990 | Scremin | |
| 5,070,858 | A | | 12/1991 | Wang | |
| 5,154,323 | A | * | 10/1992 | Query et al. | 222/153.11 |
| 5,183,189 | A | | 2/1993 | Baudin | |
| 5,383,580 | A | * | 1/1995 | Winder | 222/325 |
| 5,489,047 | A | * | 2/1996 | Winder | 222/325 |
| 5,657,908 | A | | 8/1997 | Graver | |
| 5,957,333 | A | | 9/1999 | Losenno et al. | |
| 6,138,714 | A | * | 10/2000 | Kim | 137/614.05 |
| 6,474,513 | B2 | | 11/2002 | Burt | |
| 6,481,470 | B1 | | 11/2002 | Rubenic | |
| 6,926,172 | B2 | | 8/2005 | Jaworski et al. | |
| 2002/0030068 | A1 | | 3/2002 | Burt | |
| 2005/0121476 | A1 | | 6/2005 | Pauls et al. | |
| 2006/0011665 | A1 | * | 1/2006 | Garner | 222/402.1 |
| 2008/0230559 | A1 | | 9/2008 | Nardone | |

* cited by examiner

*Primary Examiner* — Kevin P Shaver
*Assistant Examiner* — Robert Nichols, II
(74) *Attorney, Agent, or Firm* — Meroni & Meroni, P.C.; Charles F. Meroni, Jr.; Christopher J. Scott

(57) ABSTRACT

A valve wrench assembly restores functionality to an aerosol container by being selectively and removably attachable the annular container rim adjacent the container outlet, which has been damaged or otherwise compromised, and by opening the valve of the compromised outlet and subsequently directing the aerosol container's product as purposed. The valve wrench assembly comprises an annular fitting assembly and a plunger assembly. The fitting assembly interfaces the plunger assembly to the container, which plunger assembly comprises a sleeve, a nut, and a plunger structure. The sleeve comprises communicating cavities in which the nut and plunger structure are received. The plunger structure is coupled to the nut, each of which provide certain conduit. The gasket structures axially align the plunger assembly with the container outlet and matter-conducting conduit thus extends from the container outlet to the assembly outlet via the valve wrench assembly.

24 Claims, 28 Drawing Sheets

Sect. 28

Sect. 27

VALVE WRENCH ASSEMBLY KIT FOR RESTORING PURPOSED FUNCTION TO A COMPROMISED AEROSOL CONTAINER

This patent application is a continuation-in-part patent application claiming the benefit of U.S. patent application Ser. No. 12/460,856, filed in the United States Patent and Trademark Office on 24 Jul. 2009, now abandoned the specification of which is hereby incorporated in its entirety by reference thereto.

BACKGROUND OF THE INVENTION

1. Field of the Invention

The present invention generally relates to a wrench assembly kit for selectively opening a valve or to a so-called valve wrench assembly for selective and removable attachment to an aerosol container. More particularly, the present invention relates to a valve wrench assembly configured appropriately for selective and removable attachment to a standard/generic aerosol container to restore purposed function to a standard/generic aerosol container, which has been damaged or compromised at its outlet, by first opening the valve of the aerosol container's compromised outlet and subsequently directing its product as purposed. Note, the valve wrench assembly according to the present invention cannot close an aerosol container's valve, and therefore it is not a valve but rather a valve wrench by which to open the valve of a compromised outlet of an aerosol container.

2. Description of Prior Art

The prior art is fairly silent on constructions restoring purposed function to compromised aerosol can dispensers and the like. Several of the more pertinent art disclosures, however distant or distinctive, are briefly described hereinafter. For example, U.S. Pat. No. 3,638,840 ('840 patent), which issued to Ishida, discloses a Safety Valve for Aerosol Containers. The '840 patent describes a safety valve for an aerosol container which permits the discharge of the residual propellant gases in a used container when the valve stem is broken off. The container is thereby rendered safe from explosion caused by heat and also cannot be refilled.

U.S. Pat. No. 3,428,224 ('224 patent), which issued to Eberhardt et al., discloses an Aerosol Coatings Applicator. The '224 patent describes a flexible tube extended from a pressurized container to a valve which is carried in the hand of the user. The flexible tube is easily attachable to the pressurized container by way of a removable cap, which cap comprises a rim-receiving fitting for receiving the upwardly extending diametrical rim or mouth of an aerosol container.

U.S. Pat. No. 4,911,336 ('336 patent), which issued to Blake, discloses a Valve with Interchangeable Components. The '336 patent describes a valve in which standardized, interchangeable components are used for converting the valve to use either in a manually operated pump or an aerosol valve. A poppet member is reciprocable in a valve chamber between a flexible valve housing and a main cylinder housing. By making minor modifications to the poppet member and cylinder housing the valve can be adapted or converted to use either in a manually operated pump dispenser or an aerosol dispenser.

Unique valve retaining means for attaching a valve to a container is also disclosed. In one form, snap detents secure together peripheral flanges of the valve housing and cylinder housing and also secure the housings to the container neck. In another form, interfitting structure on the flanges align the housings relative to one another, and a gasket is interposed between the flanges so as to seal the flanges relative to one another and relative to the container neck, with a retaining ferrule engaging and securing the flanges to the container neck.

U.S. Pat. No. 5,183,189 ('189 patent), which issued to Baudin, discloses a control valve comprising a valve stem movable in a valve body, the stem being provided axially with two opposing recessed channels each leading to one end of the stem and separated by a base, two transverse orifices being provided in the lateral wall of the stem on either side of the base, each orifice communicating respectively with a channel, a sealing member held in the valve body and traversed by the stem, a first spring adapted to force the stem, relative to the valve body, in a direction corresponding to an outward movement by the stem, and a second spring disposed so as to prevent outward movement by the stem as long as the pressure in the interior of the container does not exceed a predetermined value.

The two springs are disposed in parallel, one end of the first spring and of the second spring resting against a means stopped by a unilateral stop of the stem, wherein this means can slide relative to the stem in the event of outward movement by the latter, and the second end of the first spring resting against a stop integral with the valve body, while the second end of the second spring rests against a stop integral with the stem. The Baudin disclosure essential purpose is to prevent product discharge from the aerosol can until opened.

U.S. Pat. No. 5,657,908 ('908 patent), which issued to Graver, discloses an Aerosol Fluid Dispenser. The '908 patent describes an apparatus for dispensing an aerosol container's pressurized fluid contents includes a base; a first, outer sleeve mounted on the base; a second, inner sleeve nested within the outer sleeve and defining a bore adapted to receive the container; and a plurality of retainers pivotally mounted to the base within the outer sleeve so as to move from a radially inward position to a radially outward position relative to the centerline of the two sleeves.

The inner sleeve is biased away from the base by a first spring, such that a first internal camming surface on the inner sleeve engages each retainer to urge it radially inwardly into engagement with the container's external curl upon advancement of the container into the nested sleeves, thereby securing the container proximate to the base. Upon moving the inner sleeve towards the base, the sleeve's first internal camming surface disengages the retainers to permit their radial expansion and, hence, the release of the container's external curl.

Further relative movement of the inner sleeve permits a second internal camming surface on the inner sleeve to engage a radial extension of each retainer thereby to further urge each retainer free and clear of the container's external curl. An annular valve-actuating piston, slidably mounted within a tubular guide projecting from the base in alignment with the centerlines of the two sleeves, is biased away from the base and into engagement with the container's integral valve by a second spring interposed between the piston and the base. A length of flexible tubing is attached to the piston to receive the contents of the container released by the piston.

U.S. Pat. No. 6,481,470 ('470 patent), which issued to Rubenic, discloses an Aerosol Can and Contents Salvage Apparatus. The '470 patent describes an apparatus for puncturing an aerosol can valve, draining its contents through the puncture, and for drawing any remaining contents from the can should there be insufficient pressure in the can for it to be fully evacuated when punctured. When the valve is replaced, the can is reusable. The puncturing apparatus has a stationary compartmented piercing tube and a housing that is free to move up and down relative to the piercing tube.

The housing is spring-loaded to offer resistance to movement so that a seal is achieved between the housing and the can before the piercing tube makes contact with the can, and to return the housing to its rest position after each piercing cycle. An air cylinder is used to apply pressure to the bottom of the aerosol can so that it will move downward to engage the piercing tube and release its contents into a first compartment. A drawing cylinder contains a piston and uses vacuum means to draw contents from the aerosol can and mechanical mean to transfer such content from the apparatus through a discharge port.

The prior art thus perceives a need for a construction that is selectively and removably attachable to an aerosol container at its container outlet so that users may discharge container contents from the aerosol container despite its having a damaged or otherwise compromised container outlet.

SUMMARY OF THE INVENTION

The valve wrench assembly kit according to the present invention is essentially designed to restore the purposed function of an aerosol container by restoring its ability to dispense its products as purposed by the OEM (Original Equipment Manufacturer). In this regard, the appropriate configuration of a valve wrench assembly is that which facilitates attachment, proper alignment, and leak free activation of the valve wrench assembly. The appropriate configuration of the valve wrench assembly kit elements may or may not be that of embodiments 20, 20(*a*), 20(*b*), 20(*c*), or 20(*d*) as illustrated in FIGS. 2, 4, 5, 6, and 48. Other combinations of the valve wrench assembly kit elements according to the present invention may be required for reasons described in the following examples. Examples are: (1) The diameter 115 of the protrusion 32 of the shell of the valve 80 assembly (See FIGS. 7 and 33.) varies considerably whereas the diameters 104 and 110 of rim 10 (See FIG. 33.) do not. Consequently, the radial gap between the protrusion 32 and the rim 10 may preclude the use of the annular wrench body fitting 28 of the kit as illustrated in FIGS. 2, 3, 4, and 5. This scenario requires the valve wrench assembly to be configured with the annular wrench body fitting 28(*a*) of the valve wrench assembly kit illustrated in FIG. 6. (2) If alignment of the axis 102 (See FIGS. 27 and 28.) of the threaded sleeve 26 with the axis 101 (See FIGS. 33 and 36.) of the protrusion 32 is problematic (See FIGS. 49, and 49(*a* and *b*).), this scenario requires the valve wrench assembly to be configured with the annular gasket 21(*b*) (See FIGS. 47 and 47(*a*).) element of the valve wrench assembly kit as illustrated in FIG. 5. (3) If leakage between plunger shaft 29 and nozzle 23 is problematic (See FIG. 2.), this scenario requires the valve wrench assembly to be configured with integer nozzle-shaft 27 (See FIG. 15.) of the valve wrench assembly kit as illustrated in FIG. 6. (4) If the protrusion 32 is small in diameter 115 (See FIG. 33.), this scenario requires the valve wrench assembly to be configured with the annular gasket 21(*a*) element (See FIGS. 46 and 46(*a*).) of the valve wrench assembly kit as illustrated in FIG. 4.

The present invention is designed to be usable on aerosol containers where either its valve stem 18 of the integral valve body 16 (See FIG. 9.) is broken off (See FIGS. 12 and 13.), its non-integral valve nozzle 17 (See FIG. 7.) is lost (See FIG. 9.), or its integral stem-nozzle 17(*a*) (See FIG. 10(*b*).) is lost (See FIG. 10.). The present invention is designed to fit all standard/generic aerosol containers known to be currently used for paints, lubricates, etc. without need of modification of either (1) the valve wrench assembly kit, or (2) any known standard/generic aerosol container design as illustrated in FIG. 7.

Some of the design features of the valve wrench assembly kit are:

- It is designed to be reusable.
- It is designed to allow nozzles to be easily changed.
- It is designed to make simple assembly cleaning and other maintenance.
- It is designed to simplify the changing of seals if required for compatibility with a product dispensed from an aerosol container.
- It is designed to provide easy, tool free, and foolproof attachment. In this regard the act of attachment concurrently accurately aligns coaxially the valve wrench assembly's axial axis 102 with the aerosol container's valve stem's 18 axial axis 101. (See FIGS. 48, 48 (*a, b, c*, and *d*), 49, and 49(*a, b*, and *c*).)
- It is designed to make prerequisite preparation of an aerosol container for usage of the valve wrench assembly unnecessary or minimal.
- It is designed to be robust and abuse resistant.
- It is designed to enable adjustment of the discharge rate of the aerosol container's product.
- It is designed to make detachment easy, tool free, and foolproof.

To achieve the foregoing and other readily apparent objectives, the present invention essentially provides a valve wrench assembly for restoring purposed function, the valve wrench assembly comprising an interface fitting assembly and a plunger assembly. The fitting assembly comprises an annular fitting, resiliently deformable, fitting-based o-ring 70. The annular fitting comprises an upper fitting section, a lower fitting section, and a threaded interior section extending through the upper and lower fitting sections (See FIG. 23.).

The upper fitting section 40 (See FIG. 23.) engages an upper portion 43 (See FIG. 33.) of rim 10 of the aerosol container 11, and comprises a first exterior diameter 103 greater in magnitude than an inner rim diameter 104 (See FIG. 33.) of rim 10. The lower fitting section 41 (See FIG. 23.) has a second exterior diameter 107 and a third exterior diameter 106. The second exterior diameter 107 is lesser than the first exterior diameter 103 and the inner rim diameter 104. The third exterior diameter 106 is lesser than the second exterior diameter 107 for defining a ring-receiving groove 44 (See FIG. 23.).

The fitting-based o-ring 70 comprises an inner ring diameter 120 and an outer ring diameter 108 (See FIG. 18(*a*).). The fitting-based o-ring 70 is received in the ring-receiving groove 44. The lower fitting section 41 positions the groove-received, fitting-based o-ring against a lower, interior portion 45 of rim 10 (See FIG. 7.). The outer ring diameter 108 is greater than the second exterior diameter 107 and the inner rim diameter 104 when in a relaxed state for securing the fitting to said aerosol container 11 via said rim 10. (See FIG. 34.)

Or, the upper fitting section 40 (See FIG. 25.) engages an upper portion 43 (See FIG. 33.) of rim 10 of the aerosol container 11, and comprises a first exterior diameter 103(*a*) greater in magnitude than the outer rim diameter 110 (See FIG. 33.) of rim 10. The lower fitting section 41 (See FIG. 25.) has a first interior diameter 106(*a*) and a second interior diameter 105. The second interior diameter 105 is lesser than the first exterior diameter 103(*a*) but greater than the exterior rim diameter 110. The first interior diameter 106(*a*) is greater than the second interior diameter 105 for defining a ring-receiving groove 44(*a*) (See FIG. 25.).

The fitting-based o-ring 70 comprises an inner ring diameter 120 and an outer ring diameter 108. (See FIG. 18(*a*).) The fitting-based o-ring 70 is received in the ring-receiving groove 44(*a*). The lower fitting section positions the groove-received, fitting-based o-ring 70 against a lower, exterior portion 46 (See FIG. 7.) of rim 10. The inner ring diameter 120 is less than the second interior diameter 105 and the outer rim diameter 110 when in a relaxed state for securing the fitting to said aerosol container 11 via said rim 10. (See FIG. 35.)

The plunger assembly comprises a threaded sleeve 26, a nut 25, and a plunger shaft 29. (See FIG. 14.) The threaded sleeve 26 comprises nut-receiving 50 and plunger-receiving 51 cavities, said cavities being in communication with one another. The nut 25 is received in the nut-receiving cavity 50 and comprises a plunger-coupling cavity 52 and conduit inlets 31 and 31(*a*) communicatively engageable with the container outlet 15. (See FIG. 21.)

The plunger shaft 29 is received in the plunger-receiving cavity 51 and plunger-coupling cavity 52 and comprises plunger conduit 53 and an assembly outlet 55. The plunger shaft 29 is coupled to the nut 25 thereby providing matter-conducting conduit from the conduit inlets 31 and 31(*a*) to the assembly outlet 55.

The threaded sleeve 26 comprises external threads 42(*a*) (See FIG. 27.) for threadably engaging the threaded interior section 42 of the annular interface fitting 28 (See FIG. 23.) for enabling matter to pass from the aerosol container outlet 15 to the assembly outlet 55 via the conduit inlets 31 and 31(*a*) and plunger conduit 53.

The plunger assembly may further comprise certain spring (e.g., spring 35 (See FIG. 14.)) means for biasing the coupled plunger shaft 29 and nut 25 to a non-activated position, which spring means enable the user to selectively discharge container products. In addition, the plunger assembly may further comprise certain spring guidance means (e.g., washer 39 (See FIG. 14.)) for enhancing smooth operation, and sealing or gasket means (e.g., plunger-based o-ring 22 (See FIG. 14.)) for enhancing sealed and directed delivery of aerosol container products from the container outlet 15 to the conduit outlet 55.

The plunger or plunger structure may comprise a plunger shaft 29 and at least one interchangeable nozzle 23, (See FIG. 14.) the plunger shaft 29 and each interchangeable nozzle 23 being coupled to one another for enabling the user to selectively interchange one or more interchangeable nozzles. The interface 38(*a*)/38(*b*) (See FIG. 14.) between the plunger shaft 29 and each interchangeable nozzle is preferably tapered for enhancing the seal intermediate the shaft and each interchangeable nozzle and for effecting a slip resistant interface.

BRIEF DESCRIPTION OF THE DRAWINGS

Other features of my invention will become more evident from a consideration of the following brief description of patent drawings:

FIG. 7(*a*) is a sectional depiction of a non-activated standard/generic aerosol container showing an integral valve stem 18 and valve body 16 as opposed to an integral valve stem 18 and nozzle 17.

FIG. 8(*a*) is a sectional depiction of an activated standard/generic aerosol container showing an integral valve stem 18 and valve body 16 as opposed to an integral valve stem 18 and nozzle 17.

FIG. 9(*a*) is a sectional depiction of a non-activated standard/generic aerosol container showing an integral valve stem 18 and valve body 16 as opposed to an integral valve stem 18 and nozzle 17 (with nozzle 17 removed therefrom).

FIG. 10(*a*) is a sectional depiction showing the upper portion of a non-activated standard/generic aerosol container showing an integral valve stem 18 and nozzle 17 as opposed an integral valve stem 18 and valve body 16 (with the integral valve stem 18 and nozzle 17 removed therefrom).

FIG. 10(*b*) is a sectional depiction showing a standard/generic aerosol container integral valve stem 18 and nozzle 17.

FIG. 11(*a*) is a sectional depiction of a non-activated standard/generic aerosol container depicting a trimmed valve stem 18 in which the valve stem 18 and valve body 16 are integral (with nozzle 17 removed therefrom).

FIG. 12(*a*) is a sectional depiction of a non-activated standard/generic aerosol container depicting a broken valve stem 18 integral with the valve body 16 and in need of trimming (with the nozzle 17 removed therefrom).

FIG. 13(*a*) is a sectional depiction of a non-activated standard/generic aerosol container depicting a broken valve stem 18 integral with the valve body 16 and not in need of trimming (with the nozzle 17 removed therefrom).

FIG. 18(*a*) is an enlarged cross sectional front view depiction of the fitting-based o-ring 70 element.

FIG. 30(*a*) is a top perspective view depiction of a first length of conduit extending into a second length of conduit wherein the first length of conduit comprises a manually adjustable valve to selectively open the first length of conduit to discharge the contents of the second length of conduit as purposed. In this case the valve handle is a valve wrench assembly of one element. It is an illustration of a situation analogous with that illustrated in FIG. 30.

FIG. 31(*a*) is a top perspective view depiction of a first length of conduit extending into a second length of conduit wherein the first length of conduit comprises a manually adjustable valve, but the handle is missing—that is to say its valve wrench assembly, its handle, is missing—thereby thwarting selective release of the contents of the second length of conduit as purposed. It is an illustration of a situation analogous with that illustrated in FIG. 31

FIG. 32(*a*) is a top perspective view depiction of a first length of conduit extending into a second length of conduit wherein the first length of conduit with exposed valve stem is outfitted with a valve wrench assembly of one element from a valve wrench assembly kit of one element thereby restoring to the first length of conduit purposed function and enabling a user to selectively open the first length of conduit to discharge the contents of the second length of conduit as purposed. It is an illustration of a situation analogous with that illustrated in FIG. 32.

FIG. 45(*a*) is a cross sectional front view depiction of the first, sleeve-based, annular gasket 21 element.

FIG. 46(*a*) is a cross sectional front view depiction of the second, sleeve-based, annular gasket 21(*a*) element.

FIG. 47(*a*) is a cross sectional front view depiction of the third, sleeve-based, annular gasket 21(*b*) element.

DESCRIPTION OF THE EMBODIMENT 20

(Note, unless elements of the valve wrench assembly kit are differentiated, statements in this description are to be considered common to all configurations of a valve wrench assembly of the valve wrench assembly kit.)

Figure 8A:
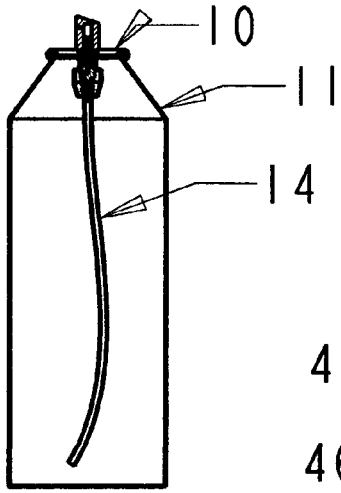
FIG. 8 is an enlarged fragmentary sectional depiction of the upper portion of an activated standard/generic aerosol container showing an integral valve stem 18 and valve body 16 as opposed to an integral valve stem 18 and nozzle 17 and showing the ejection path of aerosol container product.
Figure 8:
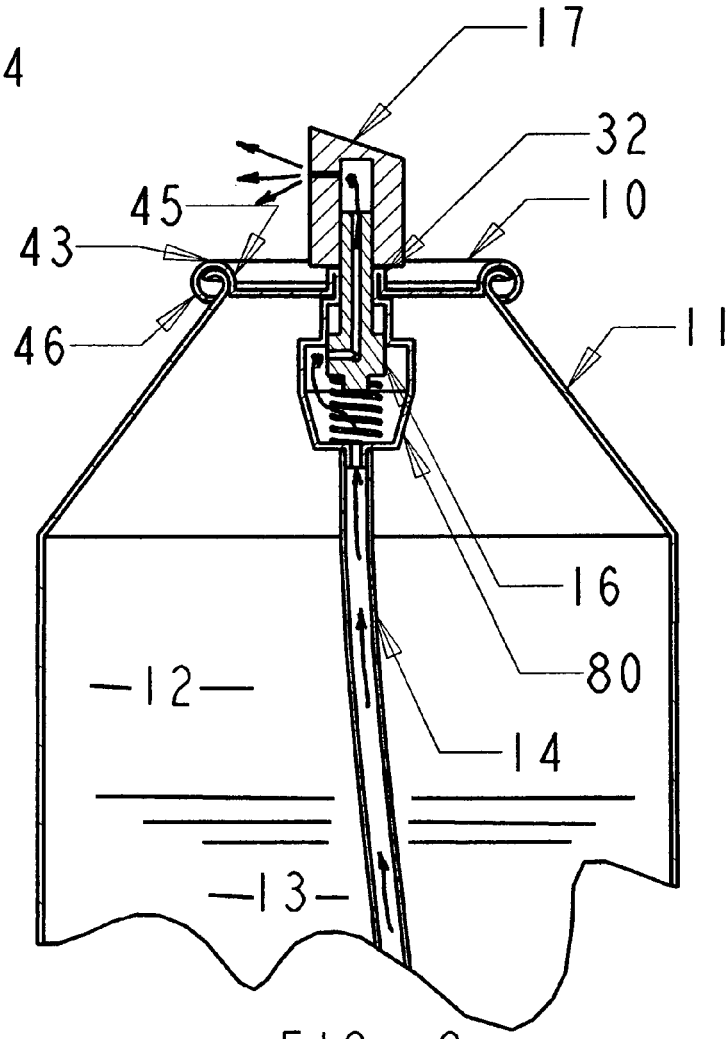

A typical aerosol container (as at 11) contains two substances. One substance is an inert gas used as a propellant as generally and generically referenced at 12. The second substance is a liquid product as generally and generically referenced at 13. The liquid product 13 may be exemplified by a lubricant, to be delivered by way of the propellant 12. The inert gas 12 is at high pressure and essentially pushes on the product 13 such that the product 13 travels through the container conduit 14 and exits the container 11 via a container outlet 15 (See FIG. 9.). (See FIG. 8.)

The aerosol container 11 is valved such that the product 13 cannot escape the aerosol container 11 until the valve is opened, usually by pushing down on its nozzle as at 17. A container conduit 14 extends from the valve at the top of the aerosol container 11 to the bottom of the aerosol container 11. If the valve is opened and the aerosol container 11 is upright, the product 13 is pushed by the pressurized inert gas 12 through the container conduit 14 and valve body 16 where it then exits the valve 80 assembly and aerosol container 11 through the valve's nozzle 17.

The valve wrench assembly 20 according to the present invention is designed to restore the functionality of an aerosol container 11 by restoring its ability to dispense container contents such as the product 13 in the manner purposed by the OEM. In this regard, it is to be noted that the valve wrench assembly 20 is designed to be outfitted upon an aerosol container 11 in which either the valve stem 18 is integral to the valve body 16 and the valve stem 18 is broken off or in which the valve stem 18 is non-integral to the valve body 16 but rather integral to the nozzle 17, and the nozzle 17 is lost.

Figure 11A:
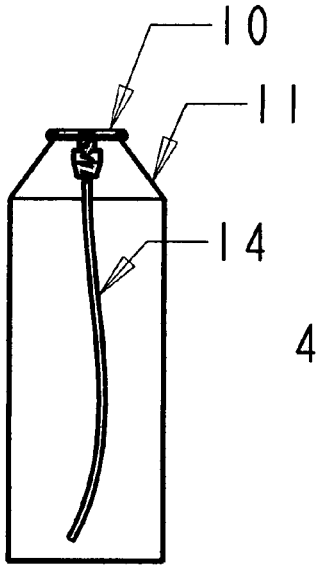
FIG. 11 is an enlarged fragmentary sectional depiction of the upper portion of a non-activated standard/generic aerosol container depicting a trimmed valve stem 18 in which the valve stem 18 and valve body 16 are integral (with nozzle 17 removed therefrom). Compare to FIG. 9.
Figure 11:
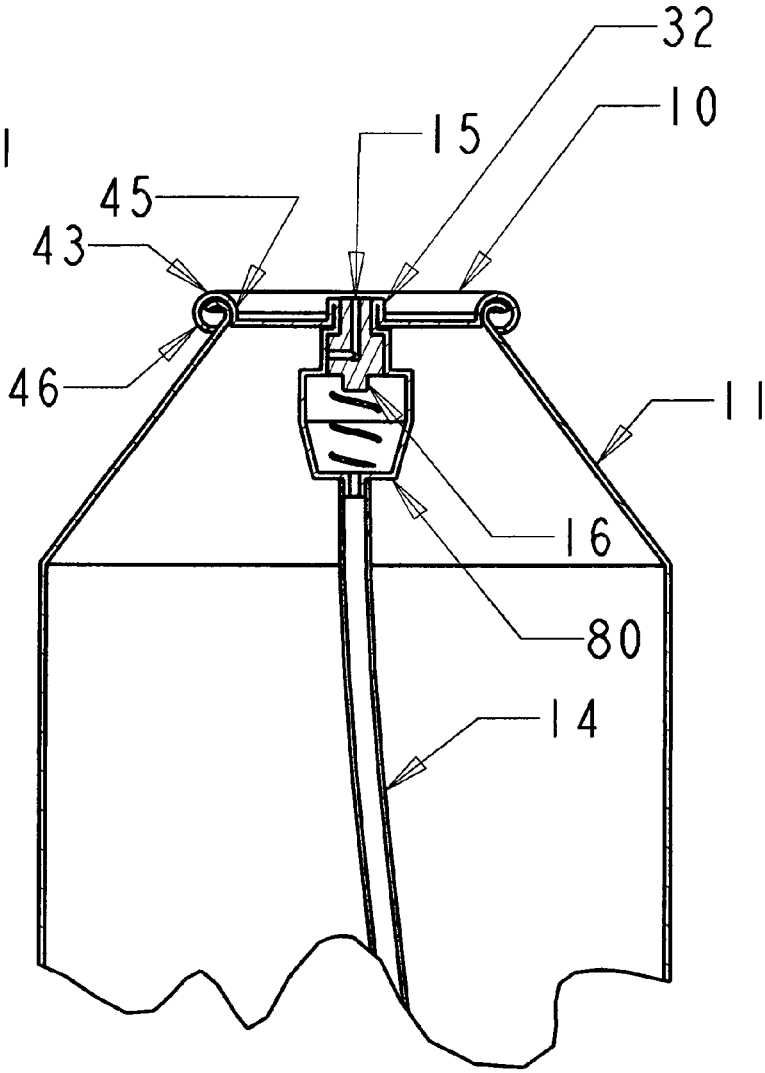
Figure 12A:
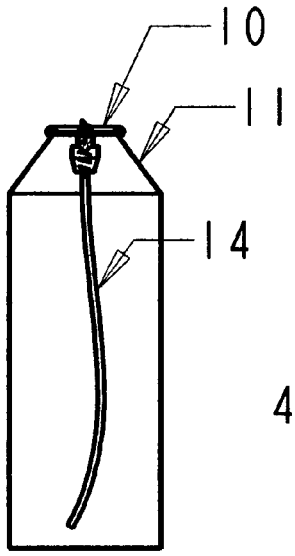
FIG. 12 is an enlarged fragmentary sectional depiction of the upper portion of a non-activated standard/generic aerosol container depicting a broken valve stem 18 integral with the valve body 16 and in need of trimming (with the nozzle 17 removed therefrom).
Figure 12:
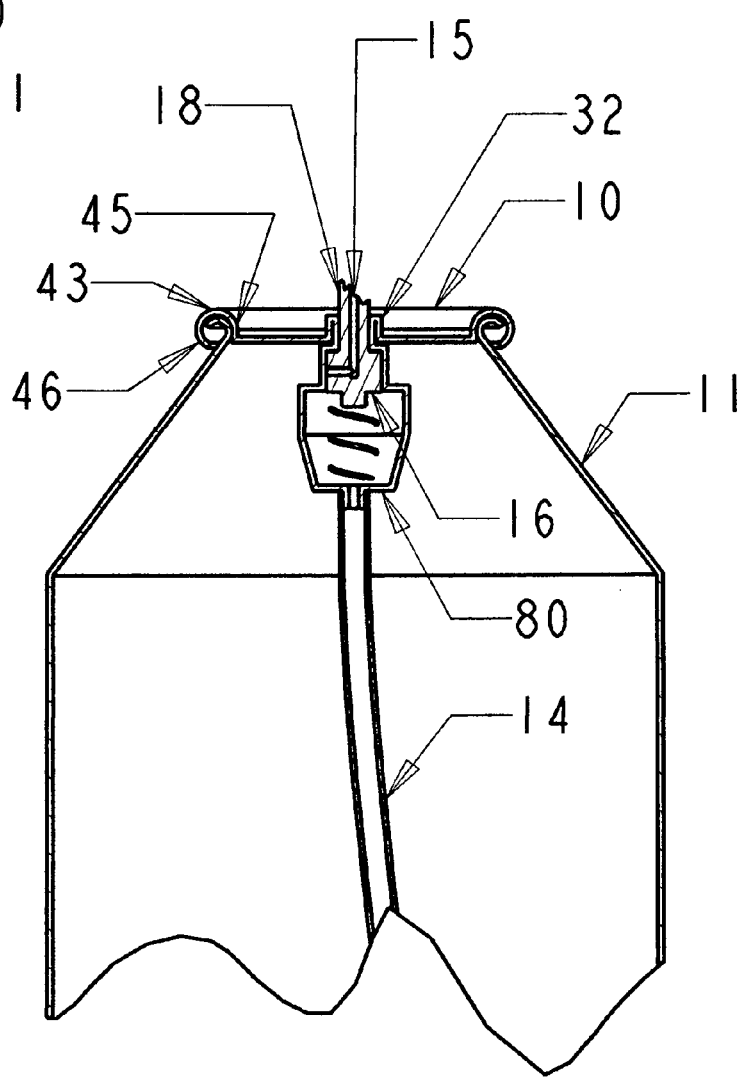

The valve wrench assembly 20 according to the present invention is designed to make any prerequisite preparation of an aerosol container 11 for the valve wrench assembly 20 usage unnecessary or minimal. A lost aerosol container integral valve stem 18 and nozzle 17 requires no aerosol container 11 prerequisite preparation (See FIG. 10.); however, if any protruding valve stem 18 is left when an aerosol container is compromised (See FIGS. 9 and 12.), the prerequisite preparation of the aerosol container 11 is minimal, and simply involves trimming the protruding valve stem 18 with either a knife or scissors to a condition illustrated in FIG. 11.

It should be further noted that the valve wrench assembly kit is designed to fit all aerosol containers 11 known to be currently used for paints, lubricates, etc. without need of modification of either the valve wrench assembly kit or any known design of an aerosol container 11. A standard/generic aerosol container 11 of the type usable in combination with the valve wrench assembly 20 is illustrated throughout the drawings submitted in support of this specification.

The valve wrench assembly 20 is designed to be reusable. In this regard, the valve wrench assembly 20 is simply removable from a first aerosol container 11, whereafter the valve wrench assembly 20 may be cleaned as required, and re-installed upon a second aerosol container 11. Further, the valve wrench assembly 20 is designed to be compatible with most products 13 as dispensed from aerosol containers 11. This is preferably accomplished by use of gasket type o-rings for sealing that can be readily changed and by use of structural materials common to most aerosol containers 11. In this regard, a protrusion-engaging, sleeve based, annular gasket 21 and a plunger-engaging, plunger-based o-ring 22 are contemplated.

The valve wrench assembly 20 may be outfitted with a variety of different types of interchangeable nozzles, an example of which is generally depicted at 23. The interchangeability of nozzles, as exemplified by nozzle 23, allows the user to change the spray pattern of product 13 discharge. In this regard, the spray pattern may be changed to effect a stream type pattern, a mist type pattern, etc. Further, the interchangeability of nozzles, as exemplified by nozzle 23, allows or enables the user to replace clogged nozzles.

It is to be noted that an alternative integral nozzle-shaft 27 element may be further provided, which otherwise combines a non-integral nozzle (as exemplified by nozzle 23) and plunger shaft (as exemplified by plunger shaft 29) into a single component as at integral nozzle-shaft 27. The term plunger may thus be said to describe either the plunger shaft 29 and nozzle 23 combination or the integral nozzle-shaft 27. The valve wrench assembly 20 incorporates the plunger shaft 29 and nozzle 23, and alternative valve wrench assemblies 20(*c*) and 20(*d*) incorporate the integral nozzle-shaft 27.

In this last regard, it should be further noted that the valve wrench assembly 20 is designed to make assembly, cleaning, and other maintenance thereof most simple. Total disassembly of the valve wrench assembly 20 requires no tools. Notably, the flat or flat structure 24 on the nut 25 interfaces with the flat structure 24(*a*) of the threaded sleeve 26, and allows the nut 25 to be disengaged/engaged by simply holding the threaded sleeve 26 while twisting the plunger counter clockwise. The threaded sleeve 26 is disengaged/engaged from the annular wrench body fitting 28 by simply holding said fitting 28 while twisting the threaded sleeve 26 counter clockwise.

The valve wrench assembly 20 is further designed to simplify the changing of seals if required for compatibility with a product 13 dispensed from an aerosol container 11. The protrusion-engaging, sleeve based, annular gasket 21 is exposed, and thus may be installed/removed manually with one's fingers. The plunger type plunger-based o-ring 22 is installed/removed by disengaging the nut 25, pulling out the plunger assembly, sliding off from the plunger shaft 29 the old plunger-based o-ring 22, sliding a replacement plunger-based o-ring 22 onto the plunger shaft 29, reinserting the plunger assembly into the threaded sleeve 26, and lastly, engaging the nut 25 by twisting the plunger shaft 29 clockwise. Notably, the valve wrench assembly 20 is designed to preclude loss of the plunger nozzle 23 from breakage due to abuse. This is accomplished by providing a close fit of appropriate length between the plunger nozzle 23 and the threaded sleeve 26.

The valve wrench assembly 20 is further designed to minimize the learning curve for usage through attachment simplicity and through it activation being as for a standard/generic aerosol container, i.e., push down on the nozzle. Attachment of the valve wrench assembly 20 to a container 11 is simply achieved by slipping on the annular wrench body fitting 28 followed by a twisting (e.g. clockwise or counter-clockwise depending on chirality of threads) of the threaded sleeve 26 to engage the protrusion-engaging, sleeve based, annular gasket 21. In this last regard, the annular wrench body fitting 28 is inserted into the container rim 10 after which the threaded sleeve 26 may be threadably received by the annular wrench body fitting 28.

Annular wrench body fitting 28(*a*), by contrast, receives the container rim 10. In this regard, it will be seen that the outer diameter(s) of the annular wrench body fitting 28 are sized so as to enable inner radial engagement of the container rim 11, while the inner diameter(s) of the annular wrench body fitting 28(*a*) are sized so as to enable outer radial engagement of the container rim 11, as discussed in more detail below.

When fully assembled upon an aerosol container 11, the valve wrench assembly 20 is operated as a standard/generic aerosol container upon which the valve wrench assembly 20 may be used. In this regard, the assembly outlet (as at 30) of the valve wrench assembly 20 may be pointed or aimed (aiming guidance being provided by appropriate beveling of the top surface of the nozzle 23 as illustrated throughout the drawings submitted in support of this specification.) in the direction in which the dispensed product 13 is to be ejected, and then push down or depress with one's finger for communicating the conduit inlet 31 (of nut 25) with the container outlet (as at 15) such that the aerosol container's product 13 may travel through the conduit structures and exit nozzle 23 via assembly outlet 30.

Attachment of the valve wrench assemblies 20 onto an aerosol container 11 is believed to be foolproof by virtue of its design. The process of outfitting the target aerosol container 11 with a valve wrench assemblies 20 is accomplished by requiring only two operations which must be correctly performed in order to properly attach the wrench assemblies 20 to an aerosol container 11. Essentially, the annular wrench body fitting 28 must engage the rim 10 such that the threaded sleeve 26 will be positioned over and around the centrally located protrusion 32 of the shell of the valve 80 assembly. Since the rim 10 is concentric to the centrally located protrusion 32 of the shell of the valve 80 assembly and since both the rim 10 and the fitting-based o-ring 70 are toroids of uniform circular cross section, the fitting-based o-ring 70 is uniformly and axi-symmetrically loaded which causes it to deform uniformly and axi-symmetrically which results in accurate alignment of the axis 102 of the threaded sleeve 26 with the axis 101 of the protrusion 32. (See FIGS. 48 and 48(*a, b, c*, and *d*).)

Figure 4:
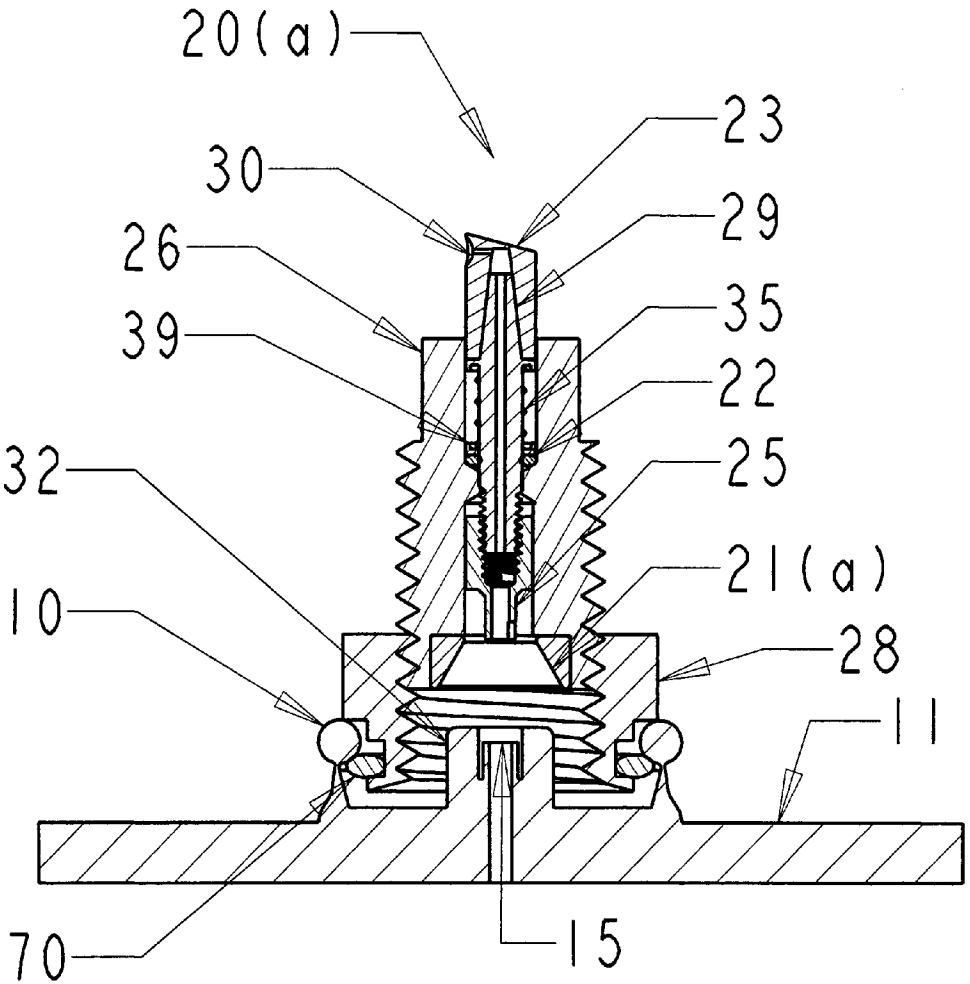
FIG. 4 is a cross sectional side view depiction of a second embodiment 20(*a*) of the valve wrench assembly kit according to the present invention otherwise depicted in FIG. 2 having an annular gasket 21(*a*) with sloped inner radial surfacing showing the valve wrench assembly attached to a standard/generic aerosol container at its upper container rim and showing the valve wrench assembly in a relaxed, non-activated state.
Figure 36:
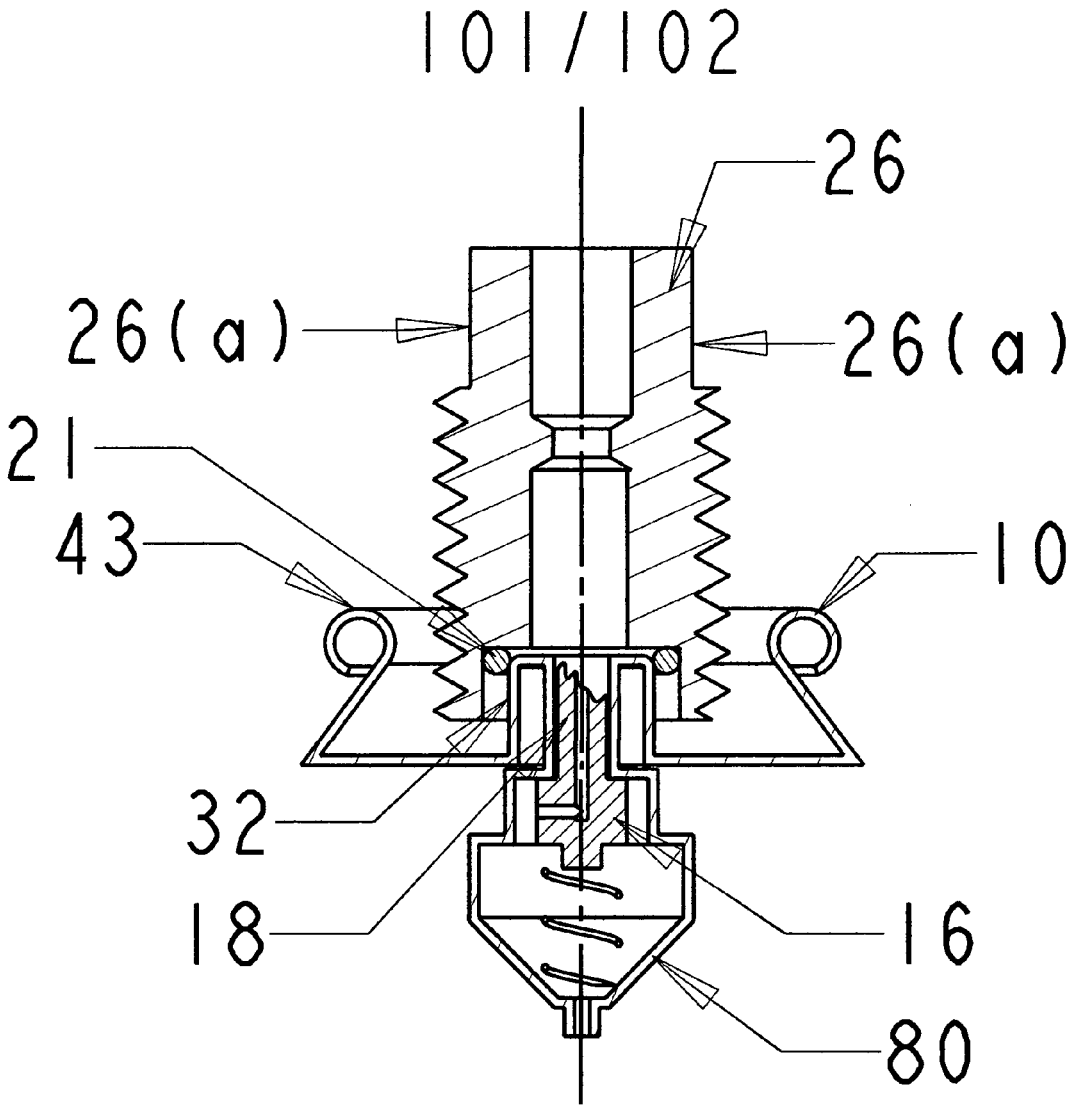
FIG. 36 is an enlarged cross sectional side view depiction of a standard/generic aerosol container 11 at its upper container rim 10 otherwise shown in FIG. 33 with a threaded sleeve 26 element and the first sleeve-based, annular gasket 21 element positioned adjacent the upwardly extending protrusion 32 of the shell of the valve 80 assembly of the aerosol container 11.
Figure 49B:
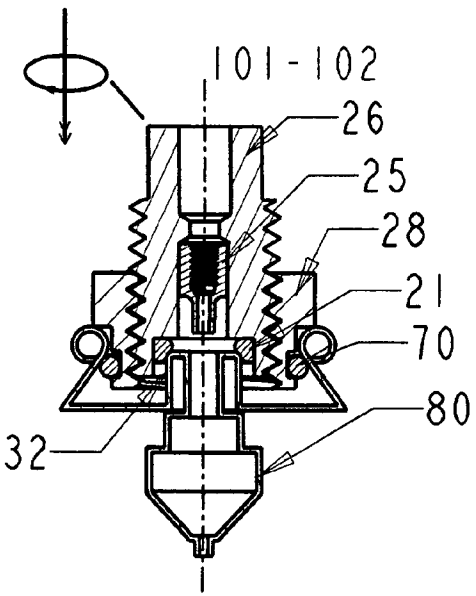
FIGS. 49, 49(*a*), and 49(*b*) are sequential cross sectional side view depictions of a partial embodiment of the valve wrench assembly kit according to the present invention which illustrate the kinematics of the final axial alignment of axis 102 of its threaded sleeve 26 with axis 101 of the protrusion 32 of the shell of the valve 80 assembly of an aerosol container 11.
Figure 49A:
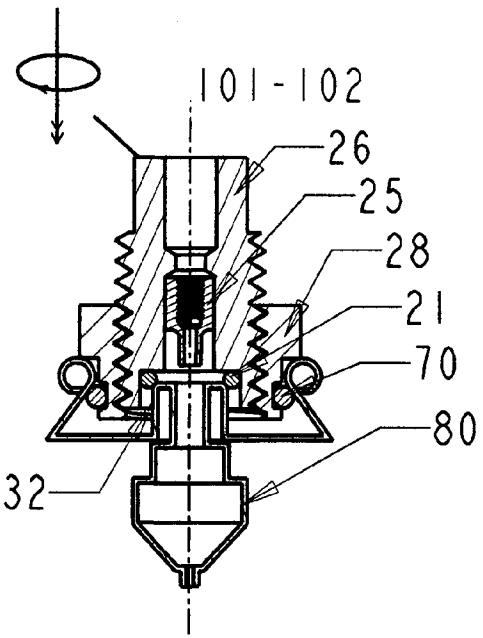
Figure 49:
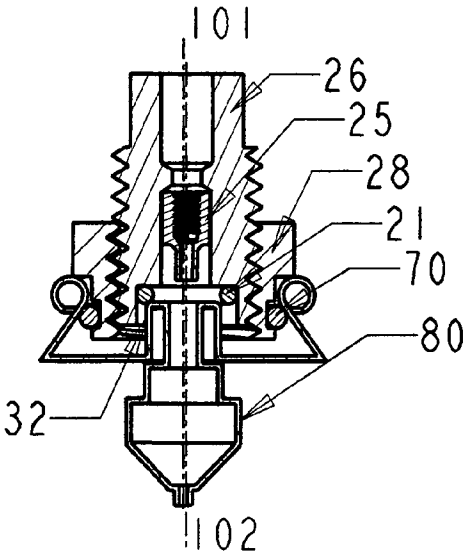

For similar reasons, the protrusion-engaging, sleeve based, annular gasket 21 functions to more precisely axially align the axis 102 of threaded sleeve 26 with the axis 101 of the protrusion 32. (See FIGS. 49, 49(*a*) and 49(*b*).) This is achieved by engaging the upper rim of the protrusion 32 with radially inner surfacing of the annular gasket 21 as may be understood from a consideration of FIGS. 4, 6, and 36. If, however, this alignment is not correct, the valve wrench assembly 20 will not function properly informing the user of improper attachment.

It may be noted that the design of the rounded upper edge of the centrally located protrusion 32 of the shell of the valve 80 assembly is made useful or incorporated into the design of the valve wrench assembly 20. In this regard, it is contemplated that as the protrusion-engaging, sleeve based, annular gasket 21 is seated, it is forced between the rounded upper edge of the centrally located protrusion 32 of the shell of the valve 80 assembly and the wall 33(*a*) of the threaded sleeve 26 (See FIG. 36.). This action centers the valve wrench assembly 20 over the aerosol container outlet 15 and, therefore, over its exit valve stem 18. Similarly, the protrusion-engaging, sleeve based, annular gasket 21(*a*) element with sloped inner radial surfacing functions to center the valve wrench assembly 20 over the aerosol container outlet 15 and, therefore, over its exit valve stem 18.

Figure 5:
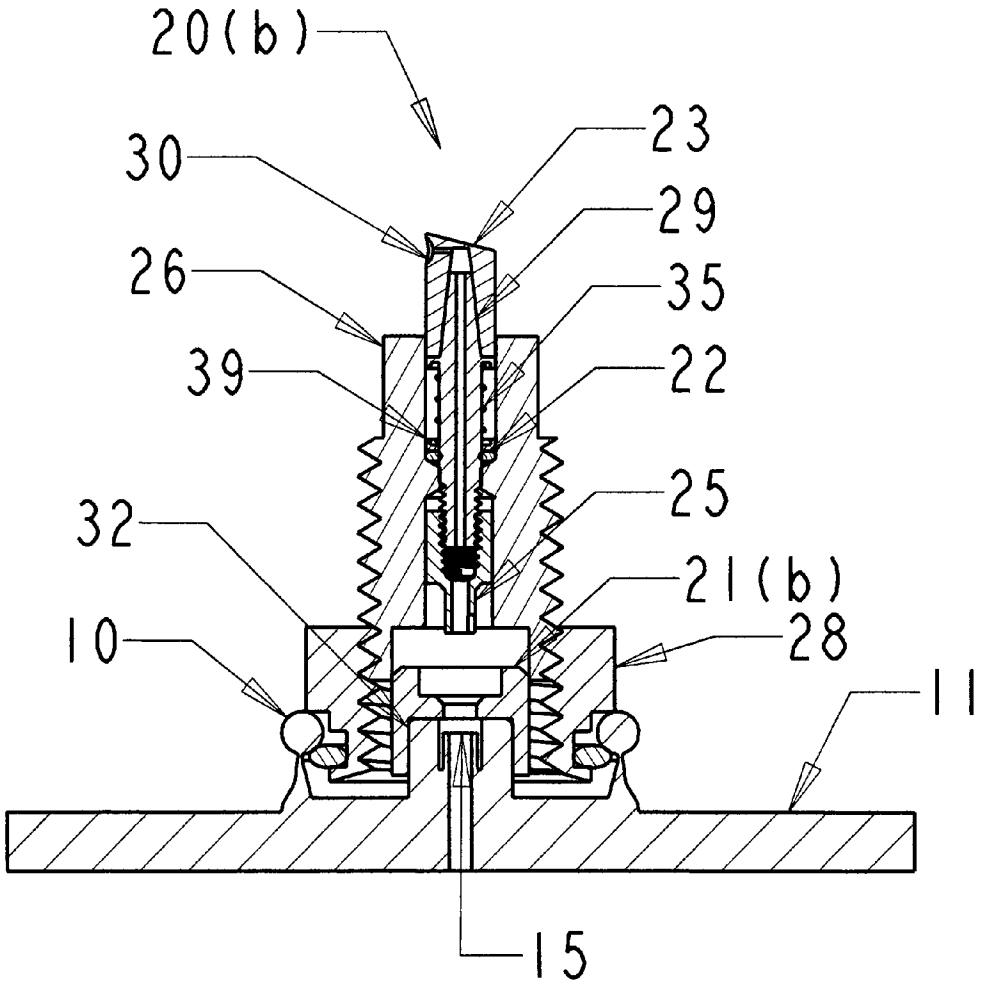
FIG. 5 is a cross sectional side view depiction of a third embodiment 20(*b*) of the valve wrench assembly kit according to the present invention otherwise depicted in FIG. 2 having an annular gasket 21(*b*) element with female structure formed to receive the protrusion 32 showing the valve wrench assembly attached to a standard/generic aerosol container at its upper container rim and showing the valve wrench assembly in a relaxed, non-activated state.

If, however, the alignment of axis 102 of threaded sleeve 26 with the axis 101 of the protrusion 32 becomes problematic, the protrusion-engaging, sleeve based, annular gasket 21(*b*) element is used as illustrated in FIG. 5.

Figures 41, 42, 43, 44:
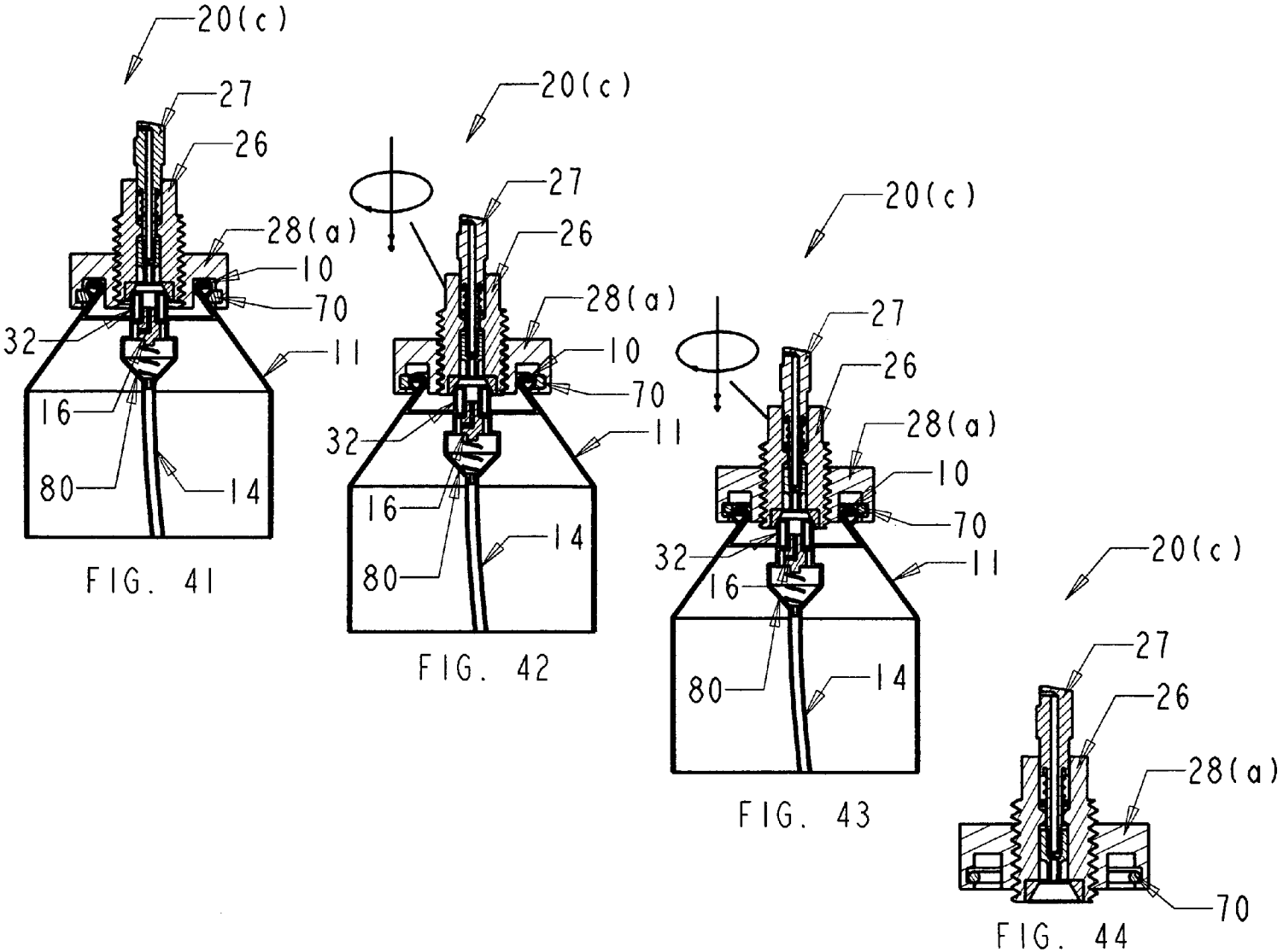
FIG. 41 is a first sequential cross sectional side view depiction showing the fourth embodiment 20(*c*) of the valve wrench assembly kit according to the present invention with the fourth embodiment 20(*c*) securely coupling its plunger assembly to the protrusion 32 of the shell of the valve 80 assembly of an aerosol container 11.
FIG. 42 is a second sequential cross sectional side view depiction showing the fourth embodiment 20(*c*) of the valve wrench assembly kit according to the present invention securely coupling its plunger assembly to the protrusion 32 of the shell of the valve 80 assembly of an aerosol container 11 and showing that consequently by twisting the threaded sleeve 26 clockwise the annular wrench body fitting 28(*a*) climbs the threaded sleeve 26 resulting in the fitting-based o-ring 70 being resiliently deformed by the container rim 10 so as to enable the fourth embodiment 20(*c*) of the valve wrench assembly kit to be removed from the container rim 10 of an aerosol container 11.
FIG. 43 is a third sequential cross sectional side view depiction showing the first embodiment 20(*c*) of the valve wrench assembly kit according to the present invention seated upon the upper container rim 10 of an aerosol container 11.
FIG. 44 is a fourth sequential cross sectional side view depiction showing the fourth embodiment 20(*c*) of the valve wrench assembly kit according to the present invention entirely removed from the upper container rim 10 of an aerosol container 11.
Figure 47:
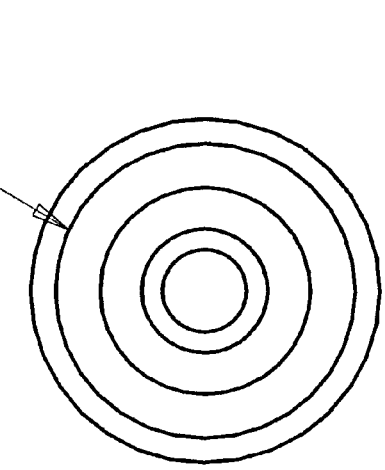
FIG. 47 is a top view depiction of the third, sleeve-based, annular gasket 21(*b*) element.

The efficacy of the plunger-based o-ring 22 seal is enhanced by ramping (as at 34 in FIG. 43) the plunger-based o-ring's seat 34 towards the interfacing surface 36(*a*) of the plunger shaft 29 and by the valve wrench assembly spring 35 further compressing the plunger-based o-ring 22 when the valve wrench assembly 20 is activated thereby increasing the pressures and the footprints at the plunger-based o-ring's seat 34 and the interfacing surface 36(*a*) of the plunger shaft 29. Notably, the need for a plunger-based o-ring installation/removal tool is eliminated. In this regard, the reader should take note that the threads 36 on the plunger shaft 29 engage the plunger-based o-ring 22 sufficiently to enable the plunger shaft 29 itself to function as a plunger-based o-ring installation/removal tool.

It is believed that the valve wrench assembly 20 according to the present invention effectively eliminates the need for thread sealant. For assembly, plunger shaft 29 must be disengaged from nut 25 generally through the use of threads as at 36. Threads 36 are located upstream of the plunger-based o-ring 22, which structural location closes off the thread leakage path eliminating the need for thread sealant. In the case of the non-integral plunger nozzle 23 and plunger shaft 29 design, a tapered interface as at 38(*a*) (plunger shaft 29) and 38(*b*) (nozzle 23) between the plunger shaft 29 and the nozzle 23 as opposed to threads is used eliminating the need for thread sealant.

In other words, an adequate seal between the non-integral nozzle 23 and plunger shaft 29 is effected without the need for sealants. In this regard, it should be noted that the tapered interface between the non-integral nozzle 23 and the plunger shaft 29 effects a seal. In addition, the tapered interface effects a slip resistant interface enabling one to twist the plunger shaft 29 for the adjustment of the valve wrench assembly's 20 stroke. If leakage between the non-integral nozzle 23 and plunger shaft 29 becomes problematic, then the integral nozzle-shaft 27 can be used.

The valve wrench assembly 20 is further designed such that an exchange/replacement of the non-integral nozzle 23 requires no tools. First the valve wrench assembly's 20 stroke is adjusted to zero stroke. To achieve this end, the spring 35 may be compressed to its solid height by twisting the plunger-nozzle assembly (clockwise) via the nozzle 23. Then, the old nozzle 23 is simply pulled off and a new nozzle 23 is pushed onto the plunger shaft 29. When pulling, the plunger shaft 29 is constrained at the interface 34(*a*) between the nut 25 and the threaded sleeve 26. When pushing, the plunger shaft 29 is constrained by the fact that the spring 35 is compressed to its solid height providing essentially a rigid load path through the spring 35 and plunger-based o-ring 22 to the threaded sleeve 26.

Exchange/replacement of the integer nozzle-shaft 27 to exchange nozzles also requires no tools. The integral nozzle-shaft 27 is simply unscrewed from the nut 25 by twisting the integral nozzle-shaft 27 (counter clockwise) until disengagement occurs. However, in this case, removal of the integral nozzle-shaft 27 may result in removal of the spring 35, the plunger-based o-ring 22, and the washer 39 all of which later need to be re-assembled onto the new integral nozzle-shaft 27 for insertion into the threaded sleeve 26.

The valve wrench assembly 20 is designed to enable adjustment of the discharge rate of the aerosol container's product 13 from off to its full discharge rate. This is accomplished by adjusting the stroke of the valve wrench assembly 20. As the valve wrench assembly's 20 stroke is increased, the more the valve body 16 can be inserted into aerosol container's valve 80 assembly thereby increasing the extent to which the aerosol container's valve 80 assembly is opened. The more the aerosol container's valve 80 assembly is opened the less is the pressure drop across the valve 80 assembly; consequently, the greater is the discharge rate.

The length of thread engagement of the plunger shaft 29 into the nut 25 controls the stroke of the valve wrench assembly 20. The valve wrench assembly's 20 stroke is dependent on the difference between the spring's 35 initial compressed height and its solid height (i.e. its fully compressed height). The spring's 35 initial compressed height is dependent on the length of thread engagement of the plunger shaft 29 into the nut 25. As the length of thread engagement is increased, the spring's 35 initial compressed height decreases until its solid height is reached at which point the valve wrench assembly's 20 stroke is zero, because the difference between the spring's 35 initial compressed height and its solid height is zero.

The valve wrench assembly 20 is further designed to inhibit unintentional change in the aerosol container's discharge rate adjustment. This is accomplished by the locking action of friction. When the valve wrench assembly 20 is activated the spring 35 is compressed increasing the force transmitted through it. Consequently, the pressures and the footprints at the plunger-based o-ring's 22 seat 34 and the plunger shaft's 29 interfacing surface 36(*a*) increase. This effects an increase in friction which acts to resist twisting of the plunger shaft 29 thereby inhibiting unintentional change in the aerosol container's discharge rate adjustment.

The valve wrench assembly 20 is further designed to preclude interference with the valve wrench assembly's 20 action due to the spring 35 rubbing against the interfacing surface 50(*b*) of the threaded sleeve 26. This is accomplished by the spring cup 36(*b*) incorporated into the plunger shaft 29 design and spring cup 39(*a*) incorporated into the washer 39 design.

It will thus be seen that the present invention generally concerns a valve wrench assembly for restoring functionality to a standard/generic aerosol container 11 as purposed by the OEM either in which the valve stem 18 is integral to the valve body 16 and the valve stem 18 is broken off or in which the valve stem 18 is non-integral to the valve body 16 but rather integral to the nozzle 23 and the nozzle 23 is lost. In either case, the aerosol container 11 is rendered inoperable unless re-outfitted with certain means for re-engaging the container outlet 15. The valve wrench assembly 20 according to the present invention is believed to provide certain means for restoring an aerosol container 11 of this sort to the functionality purposed by the OEM.

Figure 9A:
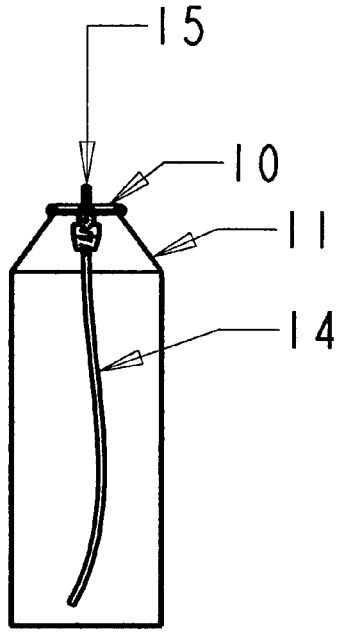
FIG. 9 is an enlarged fragmentary sectional depiction of the upper portion of a non-activated standard/generic aerosol container showing an integral valve stem 18 and valve body 16 as opposed to an integral valve stem 18 and nozzle 17 (with nozzle 17 removed therefrom).
Figure 9:
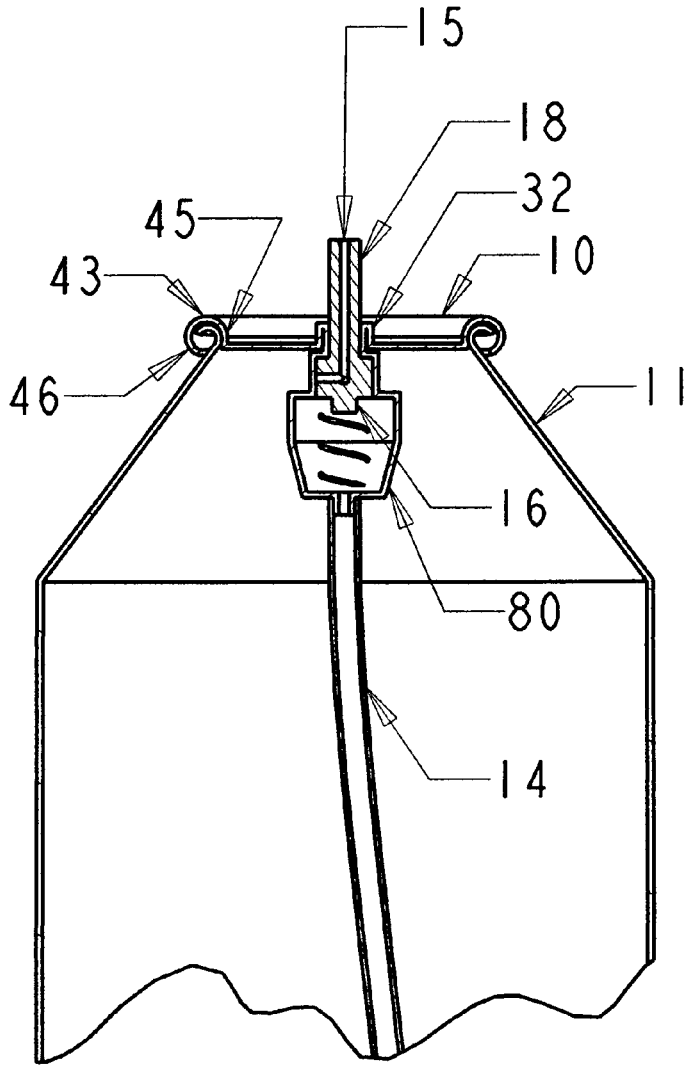
Figure 10A:
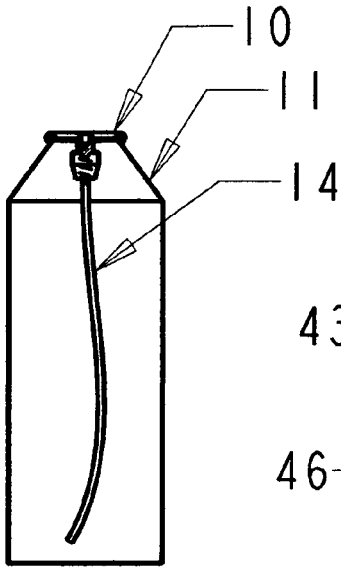
FIG. 10 is an enlarged fragmentary sectional depiction showing the upper portion of a non-activated standard/generic aerosol container showing an integral valve stem 18 and nozzle 17 as opposed an integral valve stem 18 and valve body 16 (with the integral valve stem 18 and nozzle 17 removed therefrom).
Figure 10B:
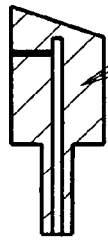
Figure 10:
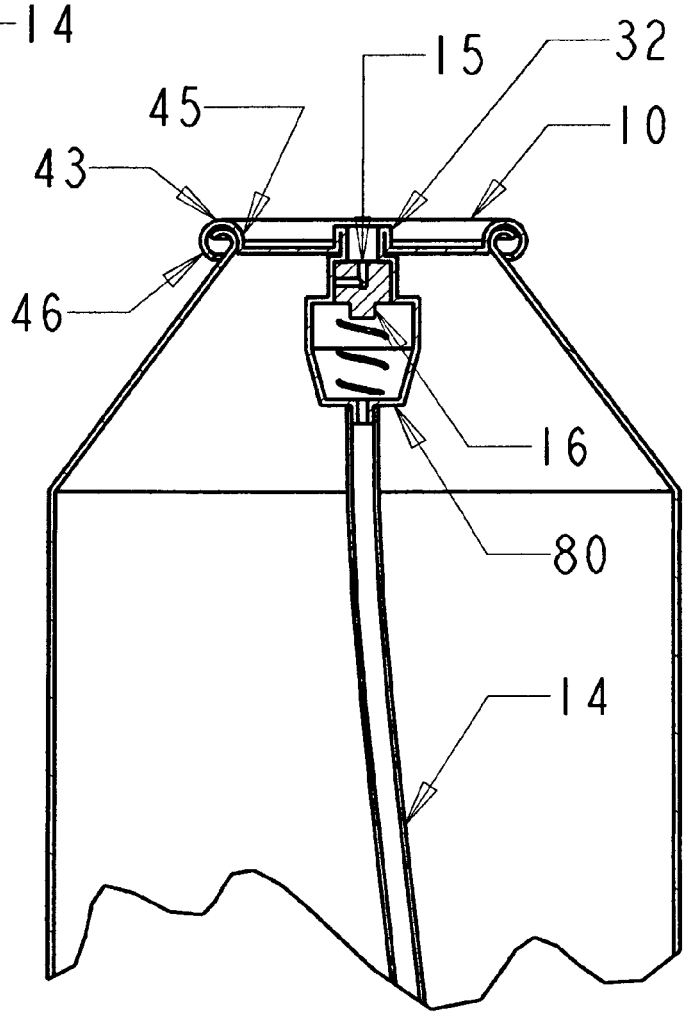

As may be seen from an inspection of the various figures, the aerosol container 11 has an annular container rim as at 10 and a container outlet as at 15 (See FIGS. 9 and 10.). The valve wrench assembly 20 according to the present invention cooperate with both the container rim 10 and the container outlet 15 to preferably and selectively discharge container product 13 from the container outlet 15. To achieve this primary objective, the valve wrench assembly 20 according to the present invention preferably comprises an annular container-to-assembly interface fitting assembly (elements 28 or 28(*a*) and 70), and a plunger assembly (all elements but 28, 28(*a*), and 70). (See FIG. 14.)

Figure 7A:
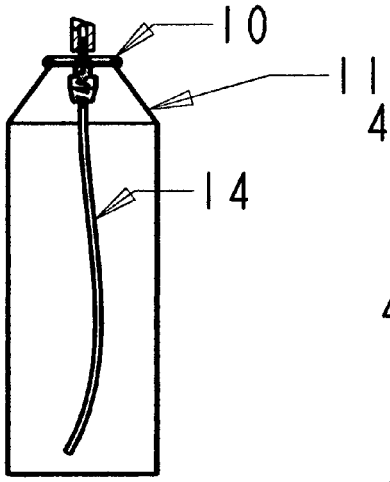
FIG. 7 is an enlarged fragmentary sectional depiction of the upper portion of a non-activated standard/generic aerosol container showing an integral valve stem 18 and valve body 16 as opposed to an integral valve stem 18 and nozzle 17 (See FIG. 10(*b*).).
Figure 7:
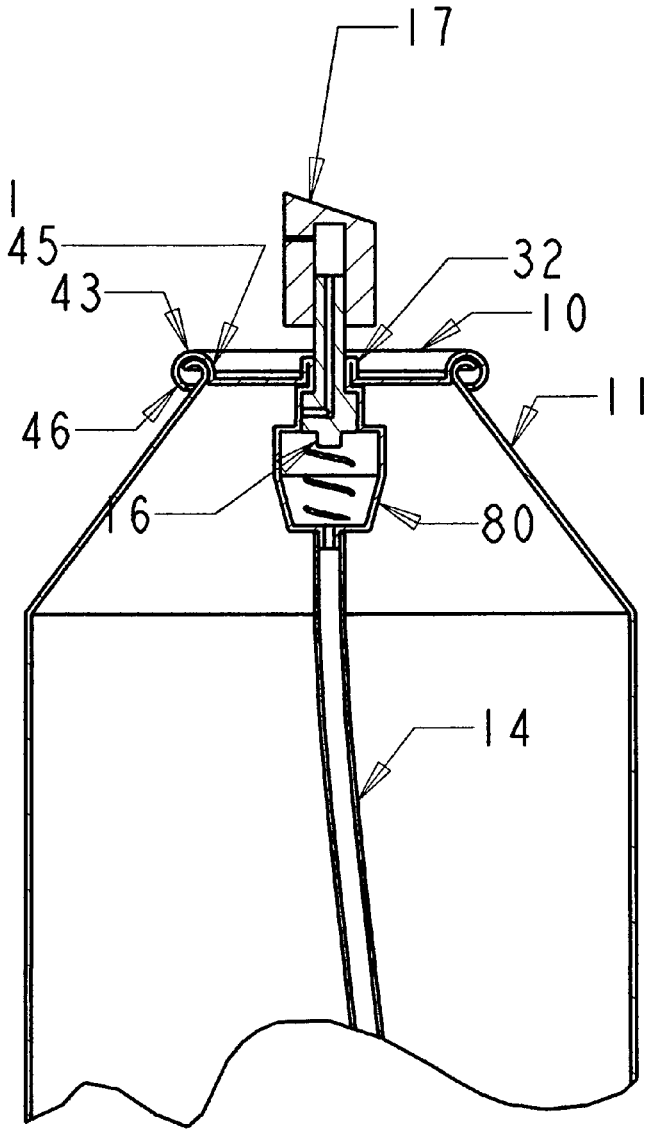
Figure 23:
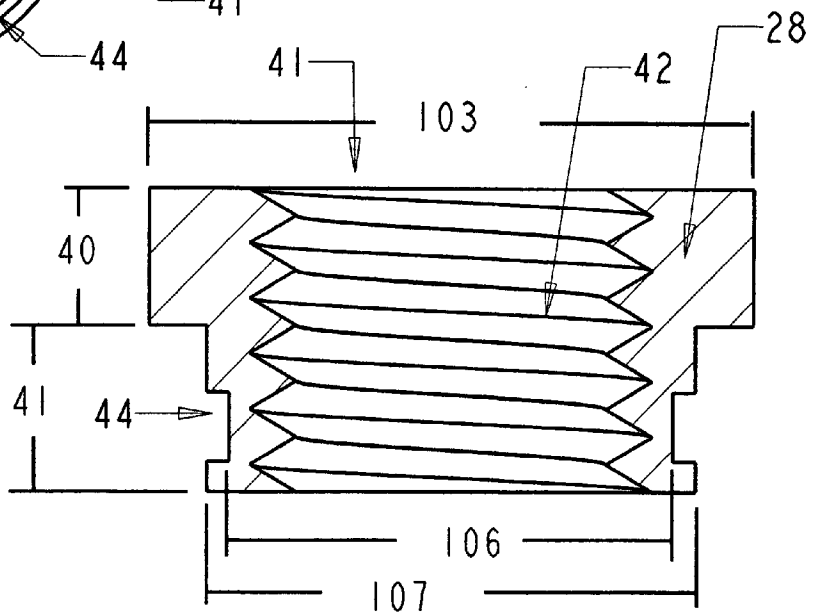
FIG. 23 is an enlarged longitudinal cross sectional side view depiction of the first annular wrench body fitting 28 element otherwise depicted in FIG. 22.
Figure 25:
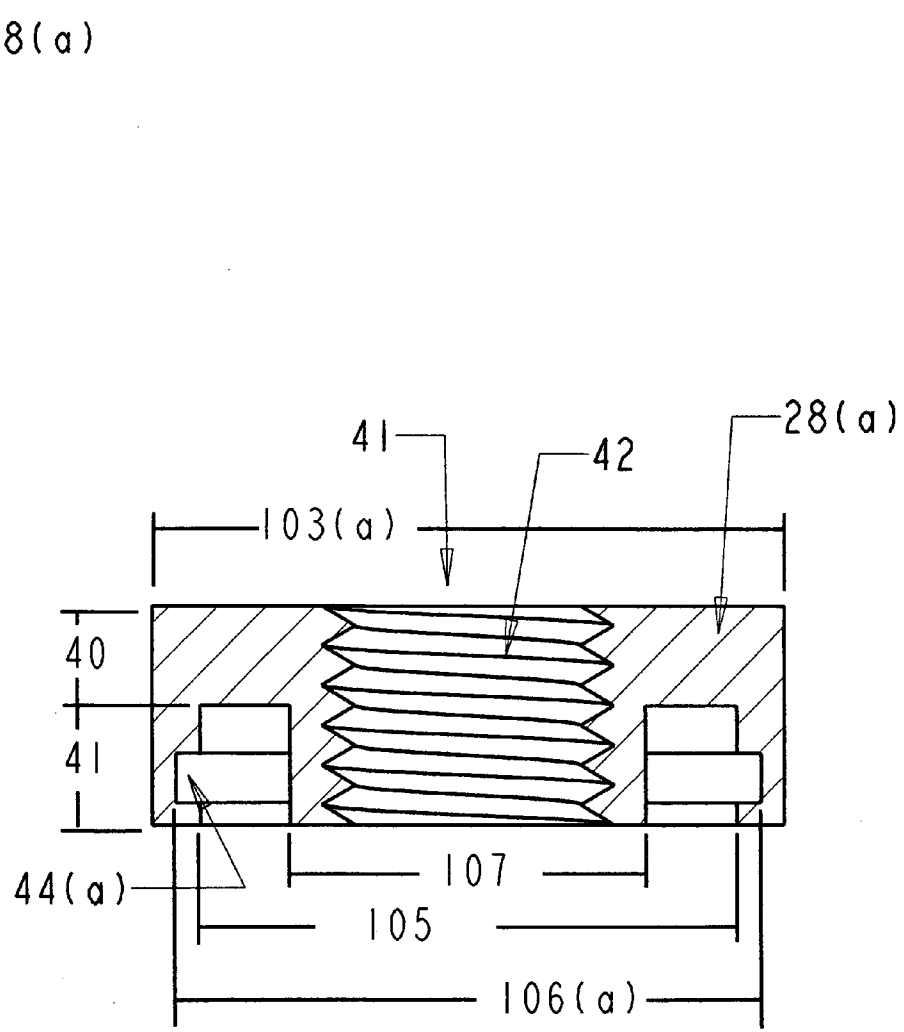
FIG. 25 is an enlarged longitudinal cross sectional side view depiction of the second annular wrench body fitting 28(*a*) element otherwise depicted in FIG. 24.
Figure 24:
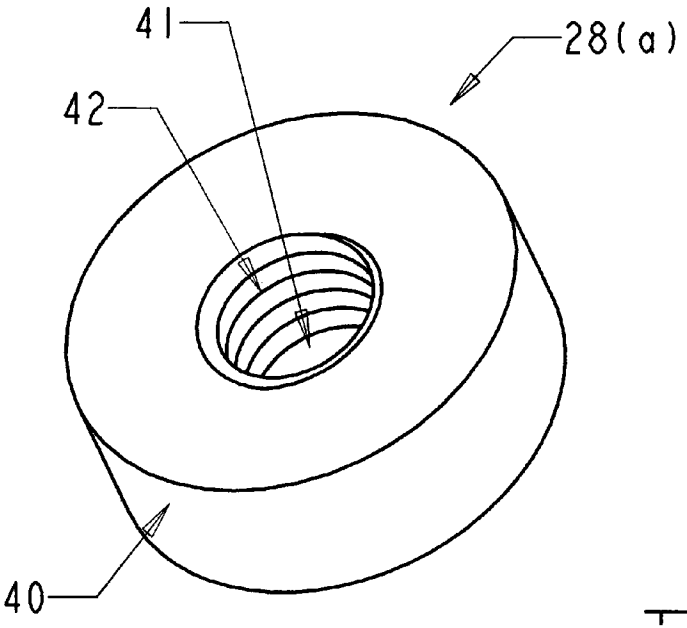
FIG. 24 is an enlarged top perspective view depiction of a second annular wrench body fitting 28(*a*) element.

The interface fitting assembly comprises an annular wrench body fitting 28 and a resiliently deformable, annular fitting-based o-ring 70. The annular wrench body fitting 28 comprises an upper fitting section as at 40; a lower fitting section as at 41, and a threaded interior section as at 42 extending through the upper and lower fitting sections 40 and 41. The upper fitting section 40 functions to engage an upper portion 43 of the container rim 10 of an aerosol container 11. (See FIGS. 7 and 23.)

Figure 33:
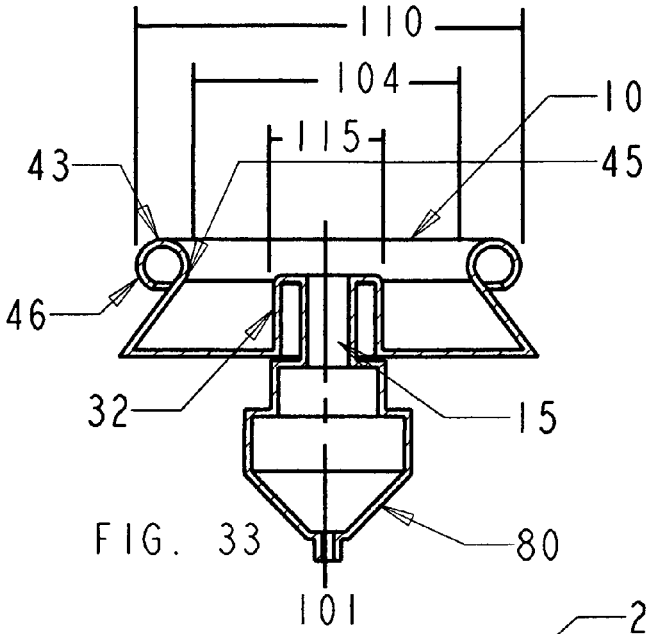
FIG. 33 is a cross sectional side view depiction of a standard/generic aerosol container 11 at its upper container rim 10 with its valve body 16 and its integral valve stem 18 and nozzle 17 removed.
Figure 34:
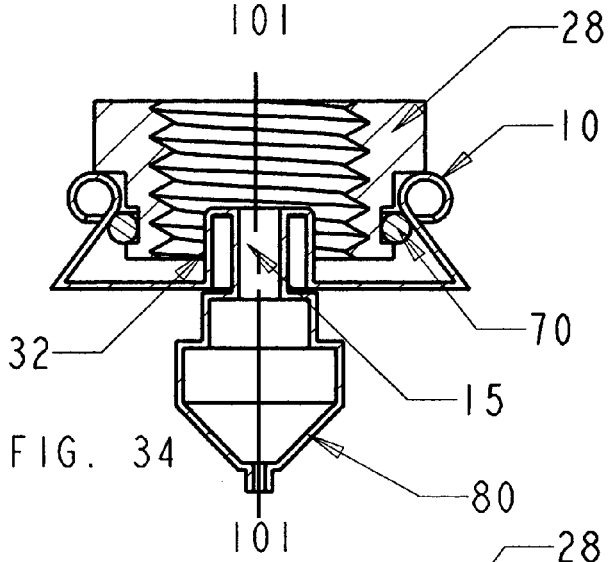
FIG. 34 is a cross sectional side view depiction of a standard/generic aerosol container 11 at its upper container rim 10 otherwise shown in FIG. 33 with the first annular wrench body fitting 28 assembly of the valve wrench assembly kit according to the present invention attached thereto.
Figure 35:
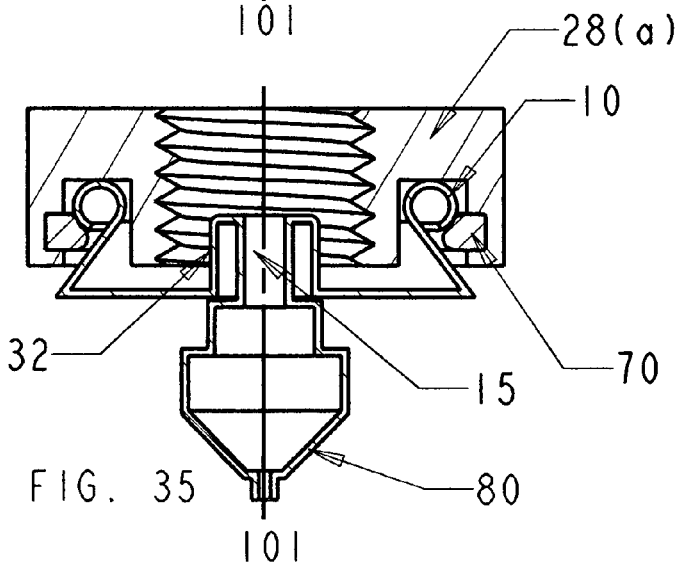
FIG. 35 is an enlarged cross sectional side view depiction of the generic aerosol container 11 at its upper container rim 10 otherwise shown in FIG. 33 with the second annular wrench body fitting assembly 28(*a*) of the valve wrench assembly kit according to the present invention attached thereto.

In this regard, it will be seen that the upper fitting section 40 comprises a first exterior diameter 103 greater in magnitude than an inner rim diameter 104 (See FIG. 33.) of the container rim 10, and that the lower fitting section 41 comprises a second exterior diameter as at 107 and a third exterior diameter as at 106. The second exterior diameter 107 is lesser in magnitude than the first exterior diameter 103 and inner rim diameter 104. The third exterior diameter 106 is lesser in magnitude than the second exterior diameter 107 for defining a ring-receiving groove 44.

Figure 18:
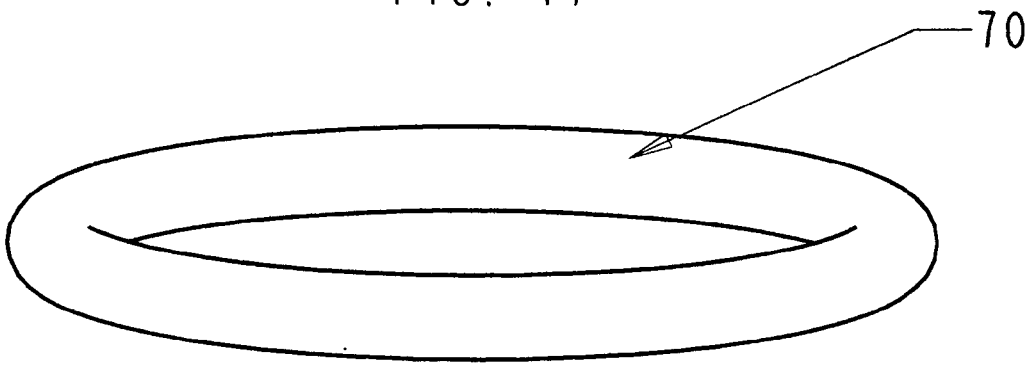
FIG. 18 is an enlarged top perspective view depiction of the fitting-based o-ring 70 element.
Figure 18A:
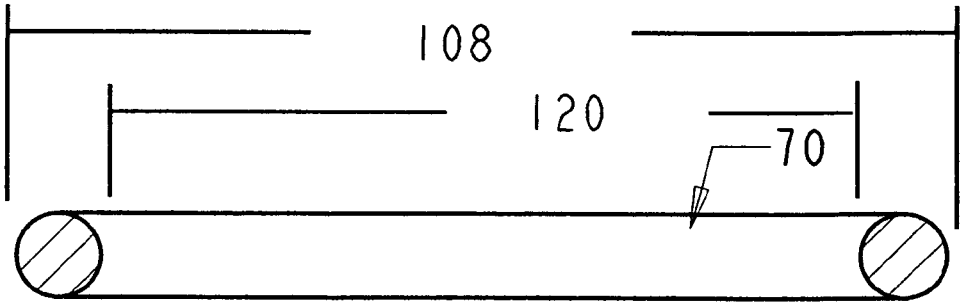

The fitting-based o-ring 70, when utilized in combination with the annular wrench body fitting 28, comprises a substantially static inner ring diameter 120, and a deformable outer ring diameter as at 108. (See FIG. 18(*a*).) The fitting-based o-ring 70 is received in the annular ring-receiving groove 44 such that the surface at or defining the inner ring diameter 120 engages the surface at or defining the diameter 106. The lower fitting section 41 thus functions to position the groove-received, fitting-based o-ring 70 against a lower portion 45 of the container rim 10.

Figures 37, 38, 39, 40:
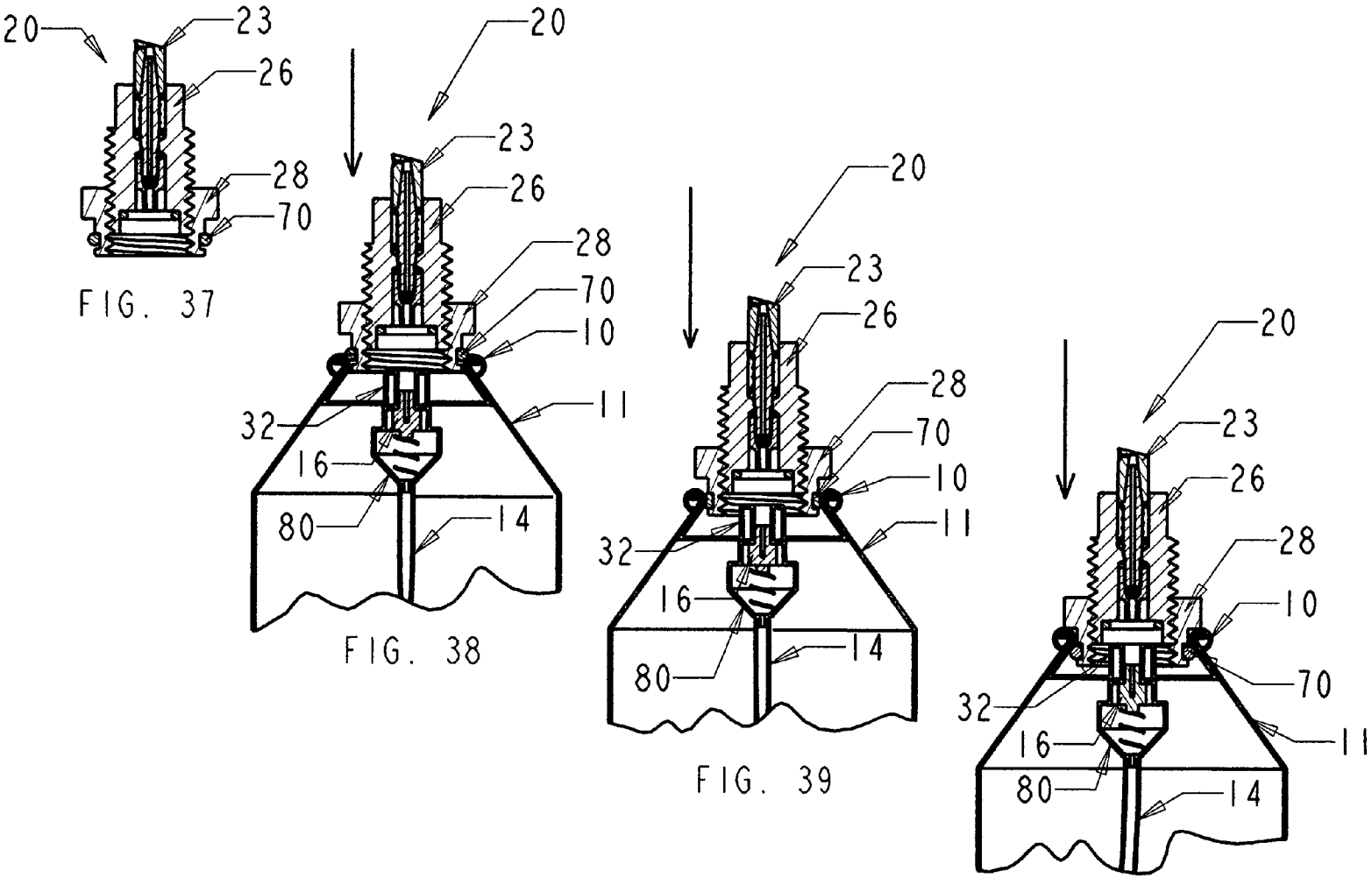
FIG. 37 is a first sequential cross sectional side view depiction showing the first embodiment 20 of the valve wrench assembly kit according to the present invention before being seated upon the upper container rim 10 of an aerosol container 11.
FIG. 38 is a second sequential cross sectional fragmentary side view depiction showing the first embodiment 20 of the valve wrench assembly kit according to the present invention seated upon the upper container rim 10 of an aerosol container 11.
FIG. 39 is a third sequential cross sectional fragmentary side view depiction showing the first embodiment 20 of the valve wrench assembly kit according to the present invention with the first fitting-based o-ring 70 being resiliently deformed by the container rim 10 so as to enable the first fitting embodiment 20 to securely couple the first embodiment 20 of the valve wrench assembly kit to the container rim 10 of an aerosol container 11.
FIG. 40 is a fourth sequential cross sectional fragmentary side view depiction showing the first embodiment 20 of the valve wrench assembly kit according to the present invention with the first fitting embodiment 20 securely coupling the first embodiment 20 of the valve wrench assembly kit to the container rim 10 of an aerosol container 11.

The outer ring diameter 108 is greater in magnitude than the inner rim diameter 104 and greater in magnitude than the second exterior diameter 107 when in a relaxed state for securing the annular wrench body fitting 28 to the aerosol container via the container rim 10. From a comparative inspection of FIGS. 37-40, it may be seen that the outer ring diameter 108 is "relaxed" in FIGS. 37, 39, and 40. The outer ring diameter 108 is resiliently deformed in FIG. 39 so as to pass the inner rim diameter 104.

The fitting-based o-ring 70, when utilized in combination with fitting 28(*a*), comprises a substantially static outer ring diameter 108, and a deformable inner ring diameter 120. The fitting-based o-ring 70 is received in the annular ring-receiving groove 44(*a*) such that the surface at or defining the outer ring diameter 108 engages the surface at or defining the fitting diameter 106(*a*). The lower fitting section 41 thus functions to position the groove-received, fitting-based o-ring 70 against a lower portion 46 of the container rim 10. The inner ring diameter 120 is less in magnitude than the outer rim diameter 110 and greater in magnitude than the second interior diameter 105 when in a relaxed state for securing the annular wrench body fitting 28(*a*) to the aerosol container 11 via the container rim 10. From a comparative inspection of FIGS. 41-44, it may be seen that the inner ring diameter 120 is "relaxed" in FIGS. 41, 43, and 44. The inner ring diameter 120 is resiliently deformed in FIG. 43 so as to pass the outer rim diameter 110.

Figure 14:
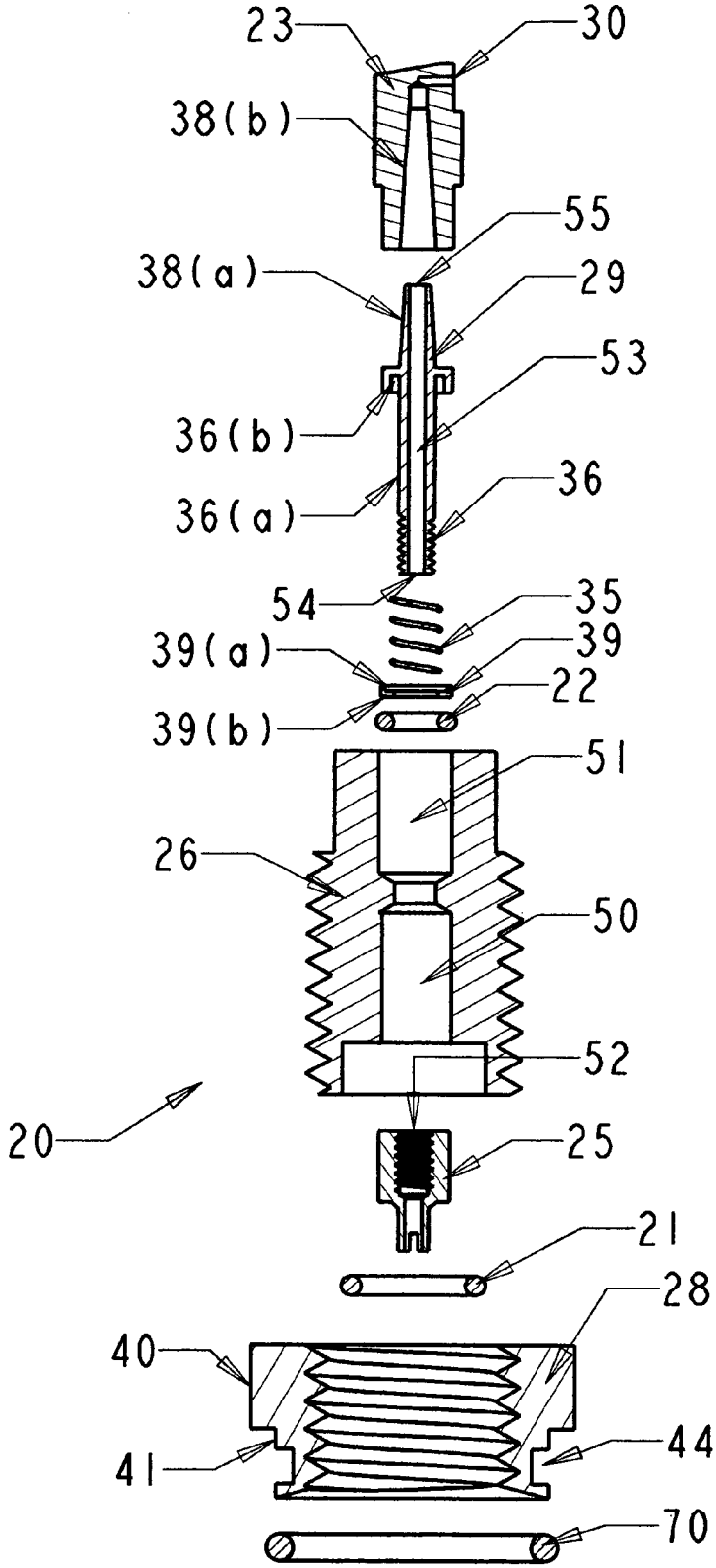
FIG. 14 is a cross sectional side view exploded depiction of the first embodiment 20 of the valve wrench assembly kit according to the present invention, showing from top to bottom, a nozzle 23 element, a plunger shaft 29 element, a spring 35 element, a washer 39 element, a plunger-based o-ring 22 element, a threaded sleeve 26 element, a first sleeve-based, annular gasket 21 element, a nut 25 element, a first annular wrench body fitting 28 element; and a fitting-based o-ring 70 element.
Figure 15:
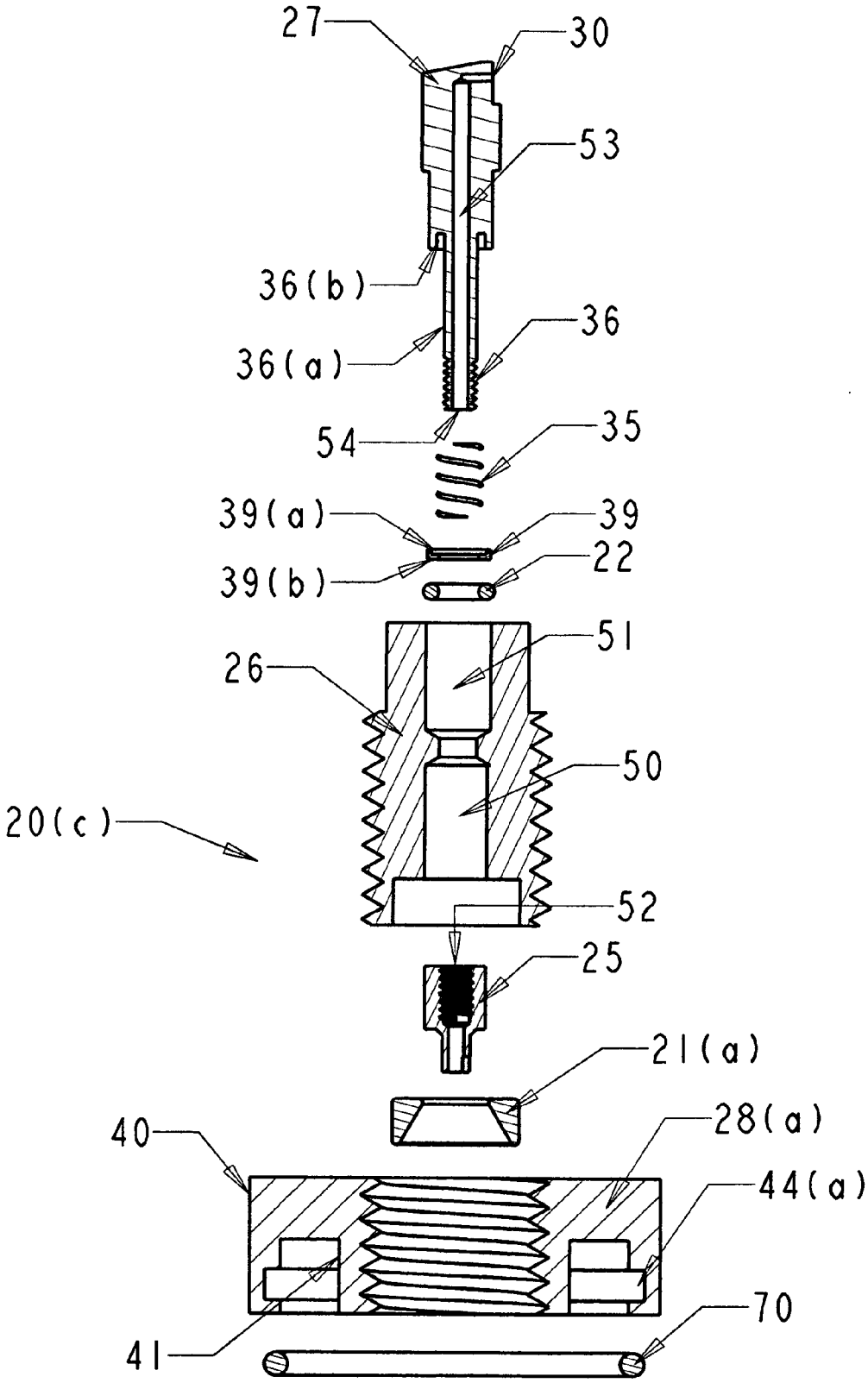
FIG. 15 is a cross sectional side view exploded depiction of the fourth embodiment 20(*c*) of the valve wrench assembly kit according to the present invention, showing from top to bottom, an integral nozzle-shaft 27 element, a spring 35 element, a washer 39 element, a plunger-based o-ring 22 element, a threaded sleeve 26 element, a second sleeve-based, annular gasket 21(*a*) element, a nut 25 element, a second annular wrench body fitting 28(*a*) element; and a fitting-based o-ring 70 element.
Figure 16:
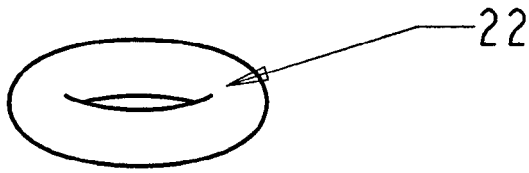
FIG. 16 is an enlarged top perspective view depiction of the plunger-based o-ring 22 element.
Figure 17:
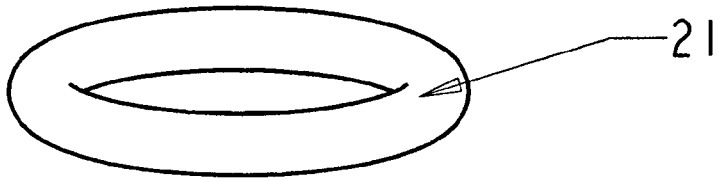
FIG. 17 is an enlarged top perspective view depiction of the first sleeve-based, annular gasket 21 element.
Figure 19:
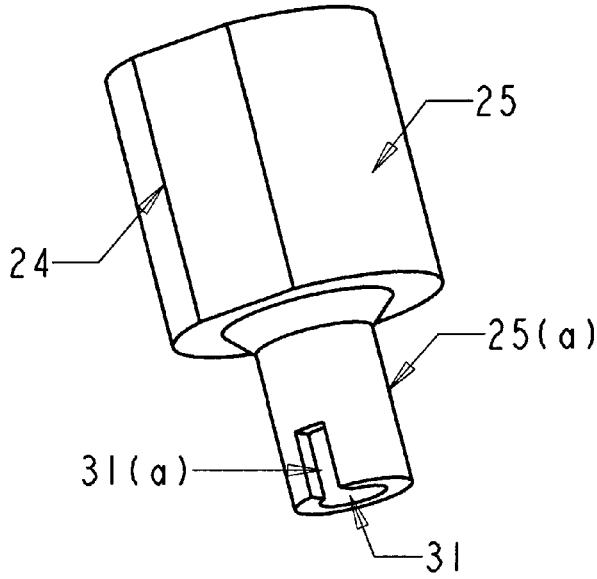
FIG. 19 is an enlarged bottom perspective view depiction of the nut 25 element.
Figure 20:
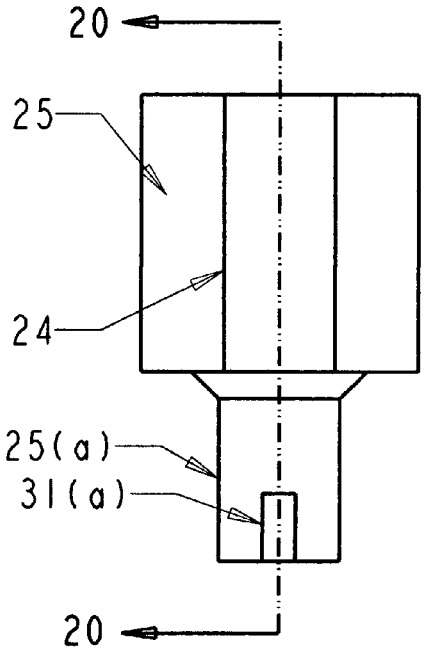
FIG. 20 is a front plan view depiction of the nut 25 element.
Figure 26:
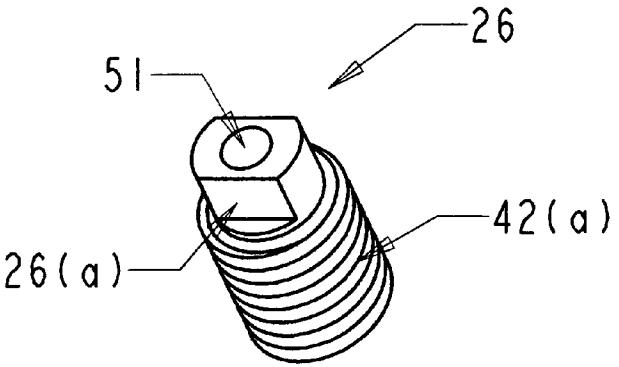
FIG. 26 is a top perspective view depiction of the threaded sleeve 26 element according to the present invention.
Figure 27:
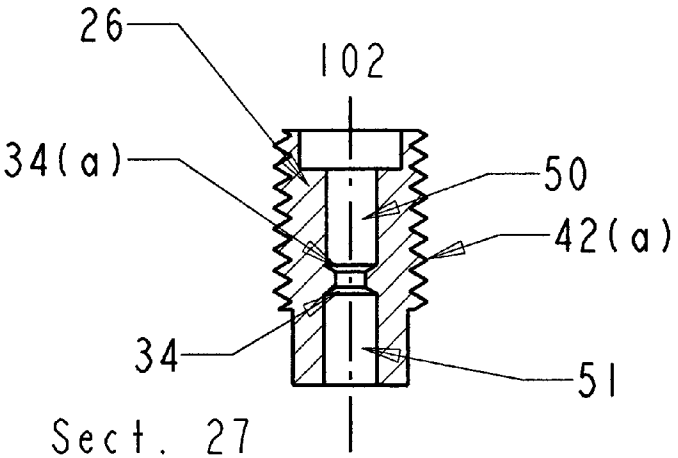
FIG. 27 is a longitudinal cross section back view depiction of the threaded sleeve 26 element as sectioned from FIG. 29.
Figure 29:
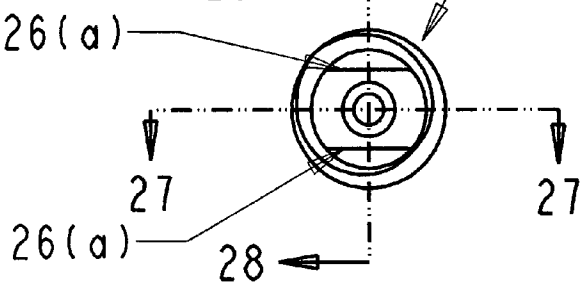
FIG. 29 is a top plan view depiction of the threaded sleeve 26 element according to the present invention.
Figure 32:
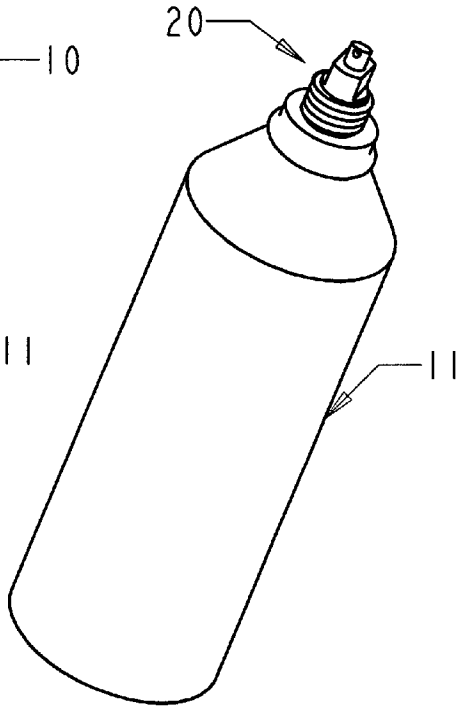
FIG. 32 is a top perspective view depiction of a standard/generic aerosol container assembly, as in FIG. 31, with a valve wrench assembly according to the present invention attached thereto thereby restoring to the aerosol container purposed function and enabling a user to selectively release the aerosol container's product as purposed.
Figure 32A:
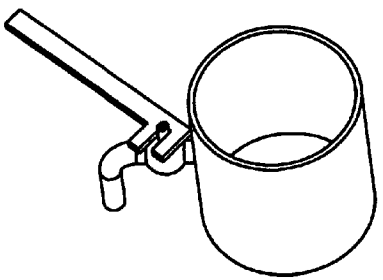
Figure 31:
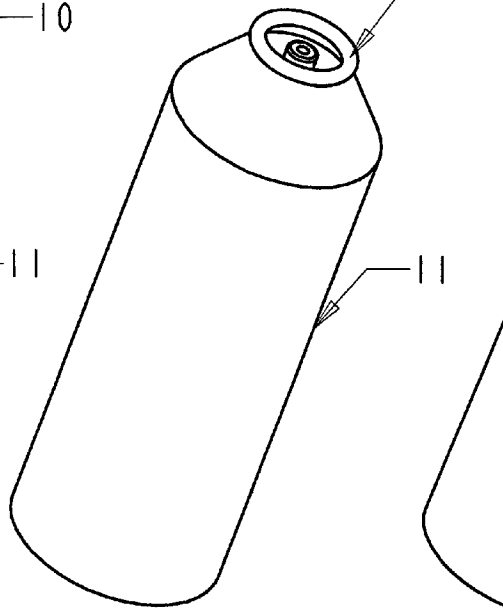
FIG. 31 is a top perspective view depiction of a standard/generic aerosol container configured with an outlet valve which can be opened by manually displacing axially its nozzle, but the nozzle is missing—that is to say its valve wrench assembly, the nozzle, is missing—thereby thwarting selective release of the aerosol container's products as purposed.
Figure 31A:
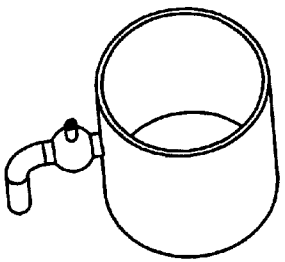
Figure 30:
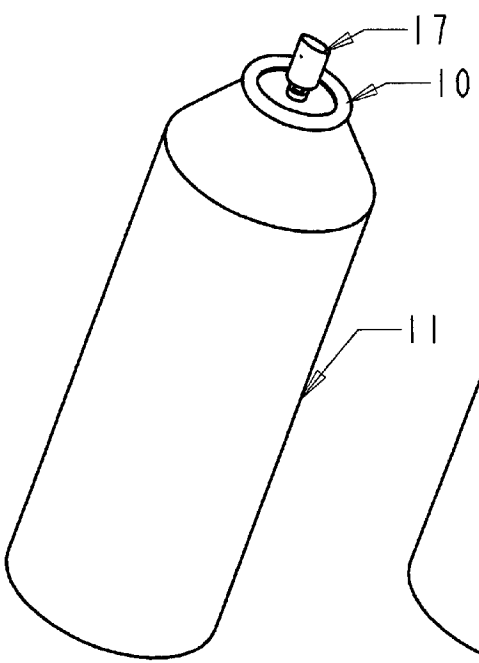
FIG. 30 is a top perspective view depiction of a standard/generic aerosol container configured with an outlet valve-nozzle assembly which valve can be opened by manually displacing axially its nozzle—that is to say by using its valve wrench assembly, the nozzle—for selectively releasing the aerosol container's products as purposed.
Figure 30A:
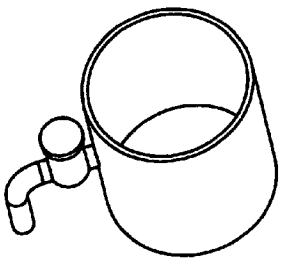

The plunger assembly essentially comprises a threaded sleeve structure, threaded sleeve 26 (See FIG. 26.); a specialized nut structure, nut 25 (See FIG. 19.); and a plunger structure, which may incorporate either plunger shaft 29 and nozzle 23 (See FIG. 14.) or an integral component incorporating both a shaft and a nozzle, as exemplified by integral nozzle-shaft 27 (See FIG. 15.). The sleeve structure, threaded sleeve 26, comprises a nut-receiving cavity as at 50 and a plunger-receiving cavity as at 51. (See FIG. 27.)

Figure 21:
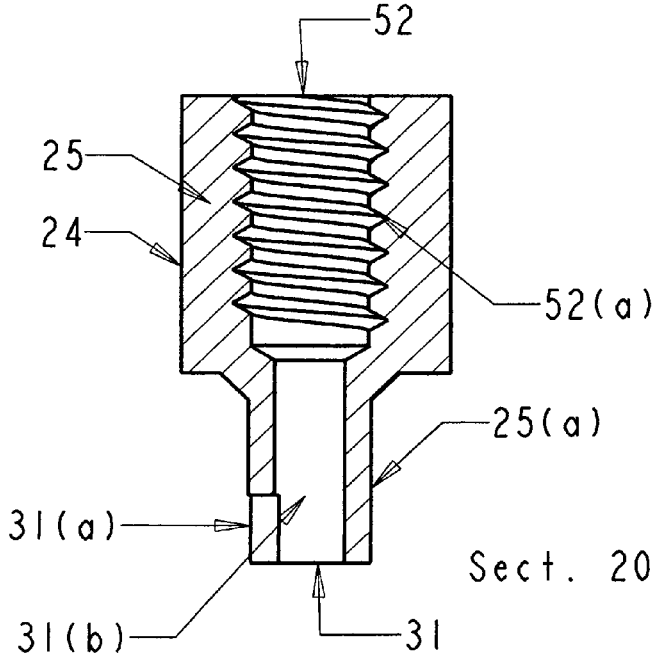
FIG. 21 is a longitudinal cross sectional side view depiction of the nut 25 element.
Figure 22:
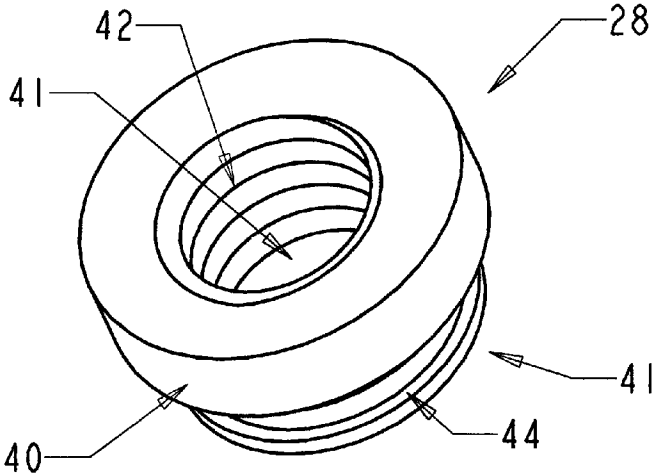
FIG. 22 is an enlarged top perspective view depiction of a first annular wrench body fitting 28 element.
Figure 28:
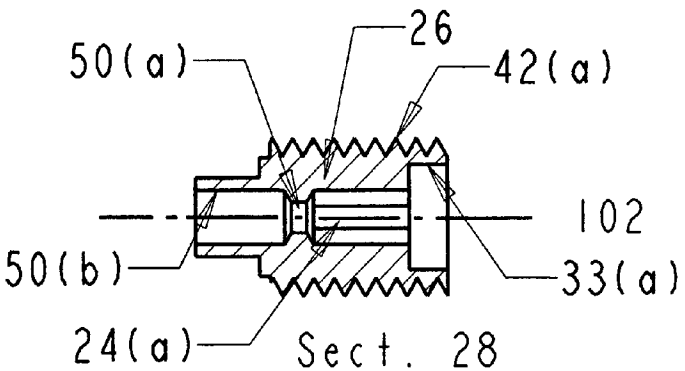
FIG. 28 is a longitudinal cross sectional right side view depiction of the threaded sleeve 26 element as sectioned from FIG. 29.

The cavities 50 and 51 are connected 50(*a*) (See FIG. 28.) or in communication with one another as generally depicted. The nut structure, nut 25, is received in the nut-receiving cavity 50 and comprises a plunger-coupling cavity as at 52 (See FIG. 21.), and a conduit inlet 31 and 31(*a*) (See FIG. 21.) communicatively engageable or otherwise cooperable with the container outlet 15 for inletting container products 13 from the aerosol container 11 for further conveyance through the valve wrench assembly 20.

The plunger structure, plunger shaft 29, is received in the plunger-receiving cavity 51 and the plunger-coupling cavity 52 and comprises certain plunger-based conduit as at 53 and a conduit inlet and outlet as at 54 and 55 (See FIG. 14.), respectively. The plunger shaft 29 is coupled to the nut 25 thereby providing matter-conducting conduit from the nut 25 conduit inlets 31 and 31(*a*) to the plunger-based conduit 53 inlet 54.

Figure 13A:
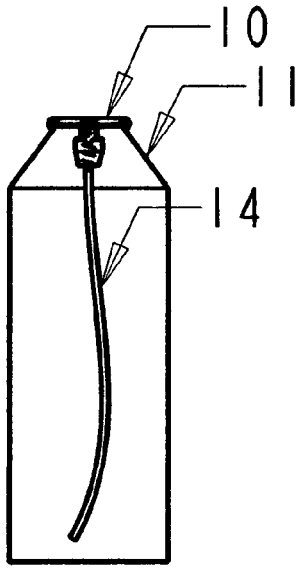
FIG. 13 is an enlarged fragmentary sectional depiction of the upper portion of a non-activated standard/generic aerosol container depicting a broken valve stem 18 integral with the valve body 16 and not in need of trimming (with the nozzle 17 removed therefrom).
Figure 13:
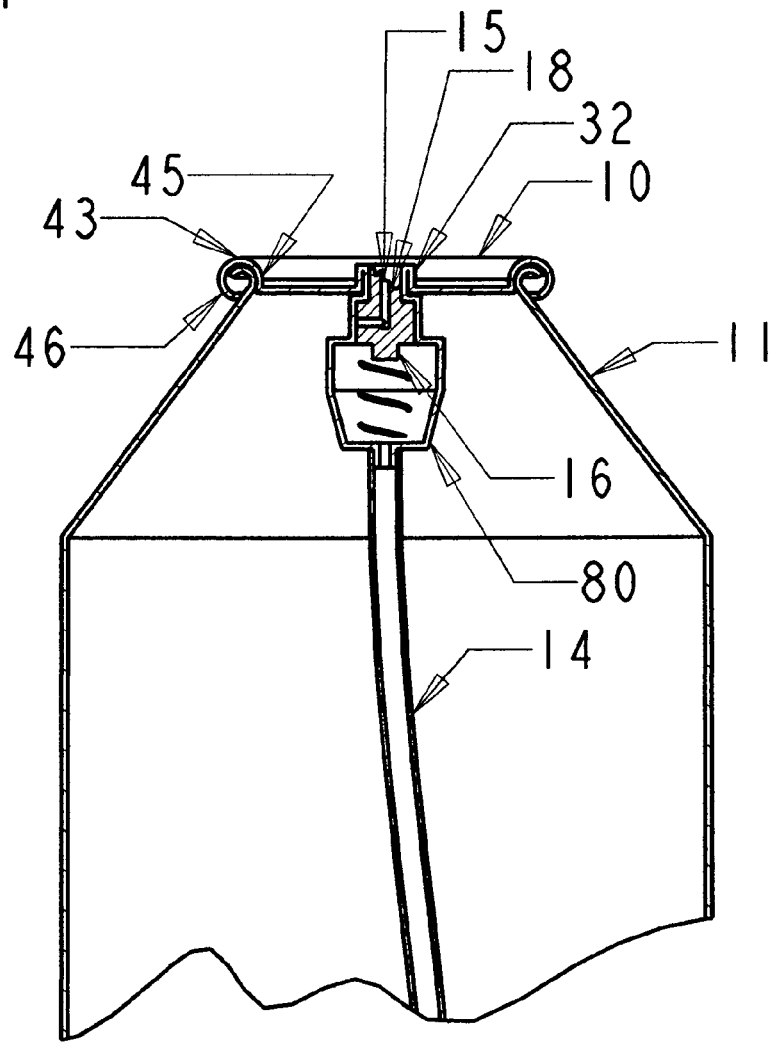

The threaded sleeve 26 is coupled to the through-hole 41 (See FIG. 23.) for enabling matter such as container products 13 to pass from the container outlet 15 to the outlet 55 via the inlet 54 and plunger conduit 53 (See FIG. 14.). The valve wrench assembly 20 according to the present invention thus functions to restore functionality to the aerosol container 11 in which the nozzle 17/17(*a*) is missing or in which the valve stem 18 integral with the valve body 16 is broken. (See FIGS. 9, 10, 12, and 13.)

Figure 46:
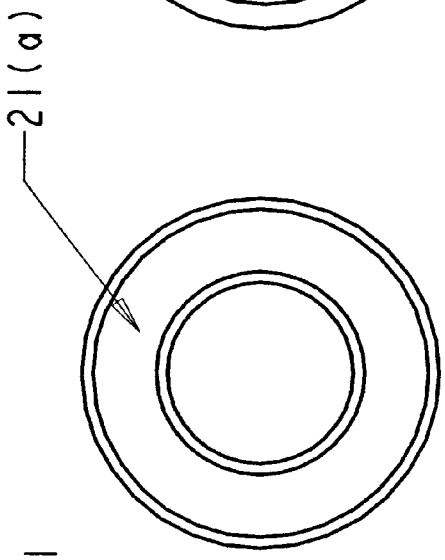
FIG. 46 is a top view depiction of the second, sleeve-based, annular gasket 21(*a*) element.
Figure 45:
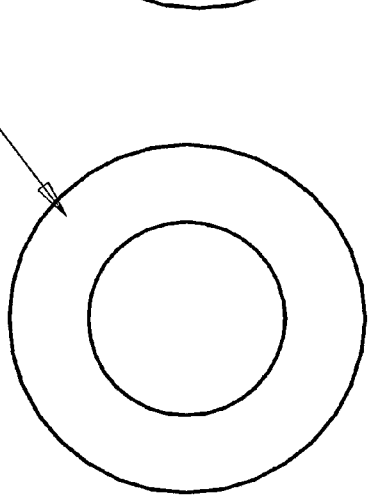
FIG. 45 is a top view depiction of the first, sleeve-based, annular gasket 21 element.
Figure 47A:
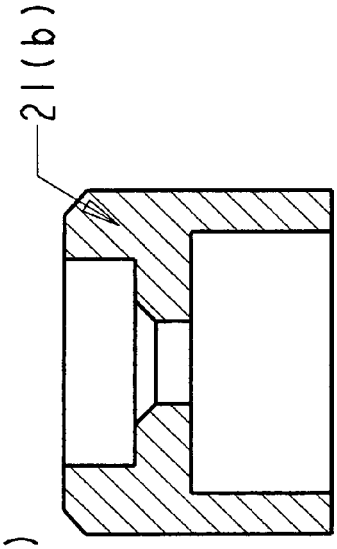
Figure 46A:
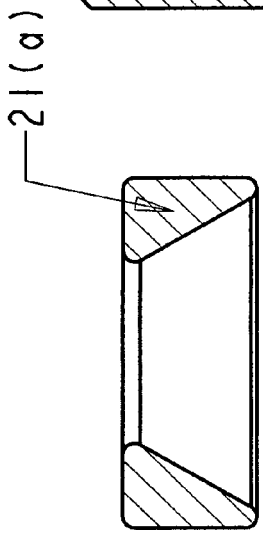
Figure 45A:
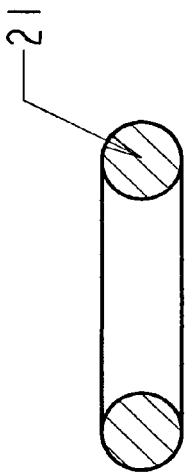

The valve wrench assembly 20 may preferably comprise certain spring means as exemplified by spring 35 (See FIG. 14.) for biasing the plunger structure and nut 25 to a non-activated position, said spring means thus enabling the user to selectively discharge container products. The plunger assembly of the valve wrench assembly 20 may further preferably comprise certain gasket means as exemplified by structures 21, 21(*a*), and 21(*b*) (See FIGS. 45-46.) for effecting valve wrench assembly 20 alignment of the axis 102 of the threaded sleeve 26 with the axis 101 of the protrusion 32 (See FIGS. 49, and 49(*a* and *b*).) and for enhancing sealed and directed delivery of container products from the container outlet 15 to the assembly outlet as at 30.

The plunger shaft as at 29 may be preferably threadably attached to the nut 25 such that the site of threaded attachment is upstream from the o-ring 22 thereby eliminating need for the thread sealant by closing off the thread leakage path. The plunger-receiving cavity 51 may preferably comprise certain ramped gasket seating structure as at 34 for enhancing sealed and directed delivery of container products from the container outlet 15 to the assembly outlet 30.

As generally noted, the plunger structure of the valve wrench assembly 20 may comprise a plunger shaft 29 element and at least one interchangeable nozzle, as exemplified by nozzle 23. The plunger shaft 29 and each interchangeable nozzle 23 may be coupled to one another for enabling the user to selectively interchange one or more interchangeable nozzles 23. The interface between the plunger shaft 29 and each interchangeable nozzle 23 may be preferably tapered, which tapered interface essentially functions to enhance the seal intermediate the plunger shaft 29 and each interchangeable nozzle 23 and for effecting a slip resistant interface.

Further, the nut 25 and the threaded sleeve 26 preferably comprise a nut-to-sleeve flat interface as at 24, which flat interface or structure 24 essentially functions to prevent the nut 25 from rotating relative to the threaded sleeve 26 (and thus enabling the user to engage/disengage the nut 25 with/from the plunger shaft 29 by manually rotating the plunger shaft 29 relative to the nut 25).

The threaded sleeve 26 of the valve wrench assembly 20 has ten basic functions, as follows: (1) to compress the annular gasket 21 against the protrusion 32 of the shell of valve 80 assembly of the aerosol can assembly 11 thereby to establish the primary seal between the valve 80 assembly of the aerosol can assembly 11 and the valve wrench assembly 20 (See FIGS. 2 and 7.); and (2) to compress axi-symmetrically the annular gasket 21, thereby to precisely align coaxially the probe 25(*a*) of the nut 25 and the protrusion 32 of the shell of the valve 80 assembly of the aerosol can assembly 11. (See FIGS. 49 and 49(*a* and *b*).)

The threaded sleeve 26 further functions (3) as an extraction tool for the valve wrench assembly 20. By employing torque using its wrenchable flats 26(*a*) to twist the threaded sleeve 26 clockwise, the valve wrench assemblies 20 can be disengaged from the aerosol can assembly 11 (See FIGS. 41-44.); (4) to provide a sealing surface 50(*b*) for the plunger-based o-ring 22 (See FIGS. 2 and 28.); and (5) to provide a sealing surface 33(*a*) for the annular gasket 21 (See FIGS. 2 and 28.); and (6) to provide a wedging surface as at 34 for the plunger-based o-ring 22 to enhance o-ring sealing (See FIGS. 2 and 27.).

Figure 1:
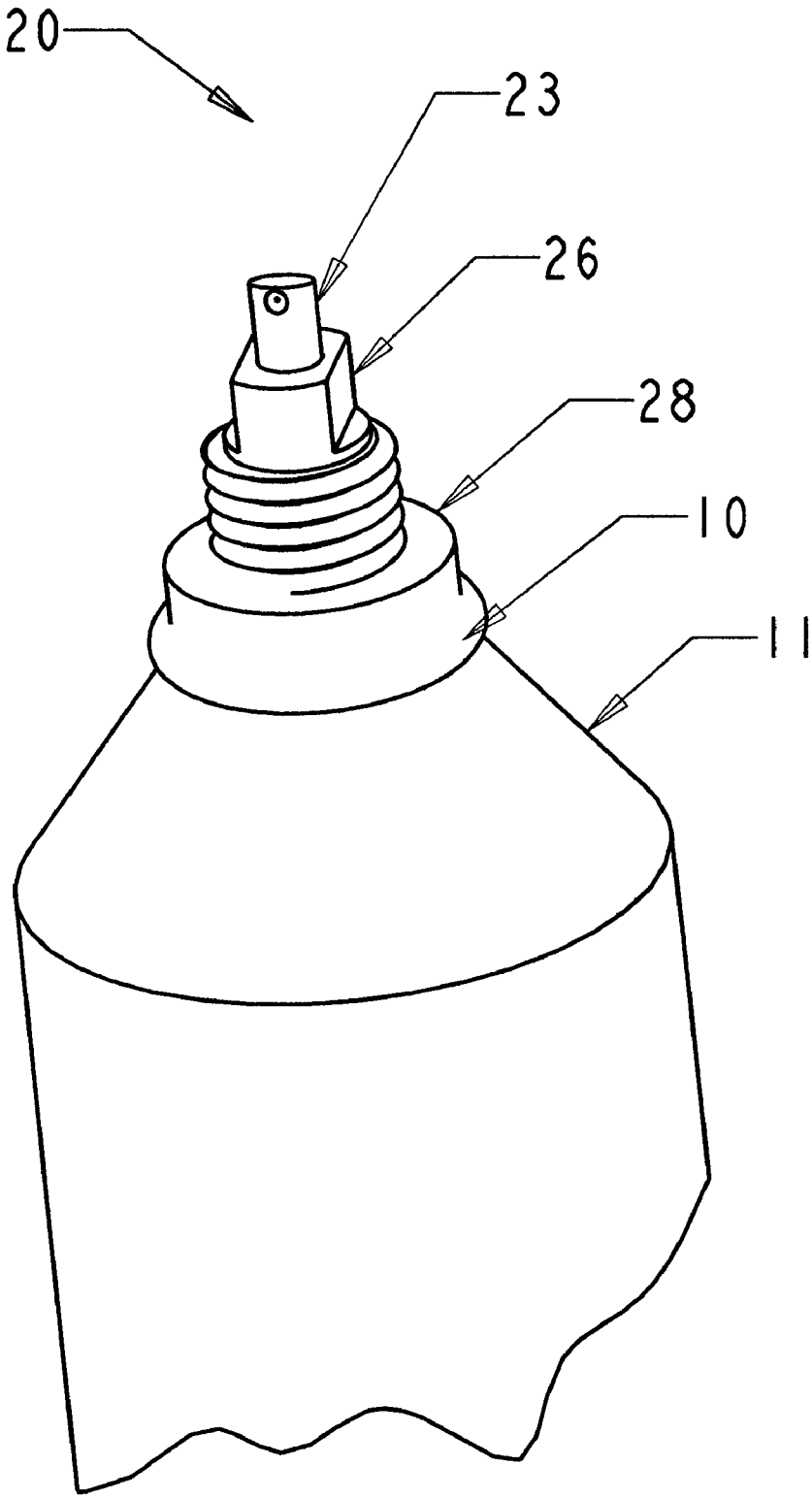
FIG. 1 is a top perspective view depiction of an embodiment of the valve wrench assembly kit according to the present invention as attached to the upper portion of a fragmentary aerosol container.
Figure 2:
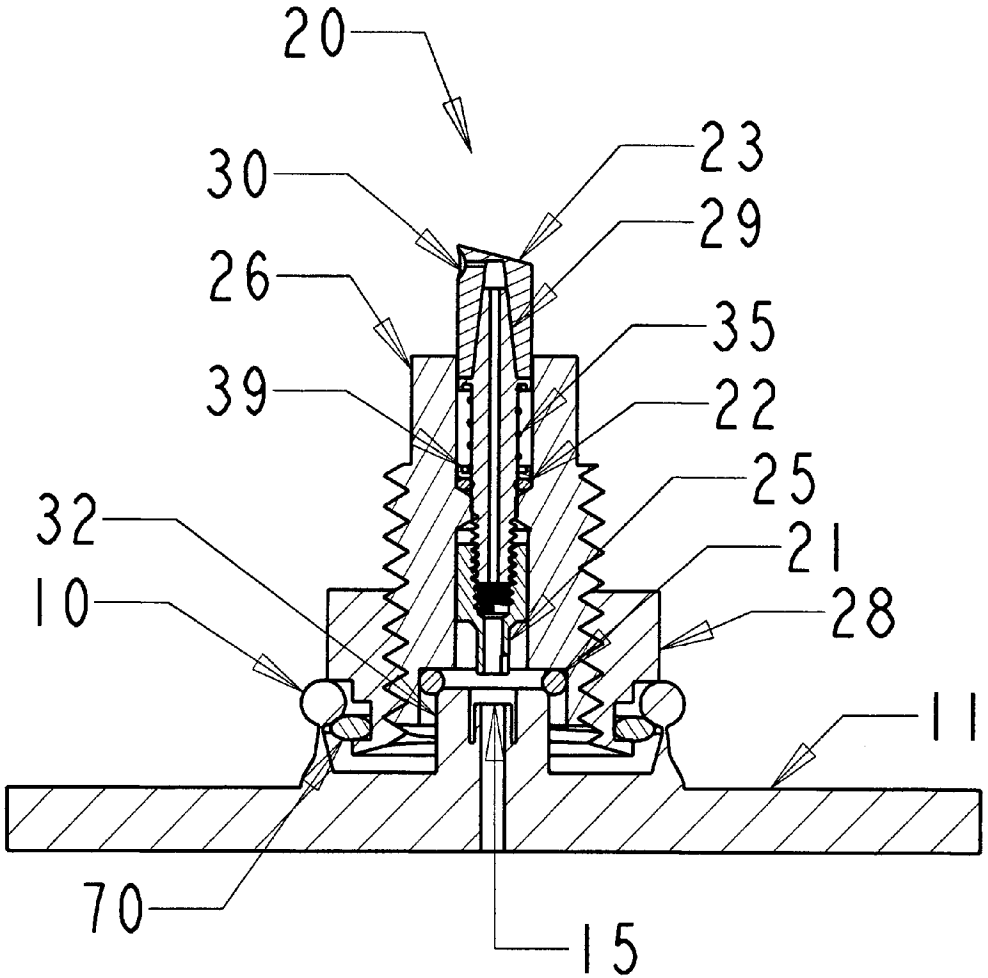
FIG. 2 is a cross sectional side view depiction of the first embodiment 20 of the valve wrench assembly kit having a non-integral nozzle 23 and plunger shaft 29, a annular wrench body fitting 28 and an annular gasket 21 according to the present invention attached to a standard/generic aerosol container at its upper container rim and showing the valve wrench assembly in a relaxed, non-activated state.

The threaded sleeve 26 further functions (7) to provide translational guidance for the plunger shaft 29 through the interfaces with the nozzle 23, the plunger shaft 29, and the nut 25 (See FIG. 2.); (8) to provide lateral support for the plunger shaft 29 through the interfaces with the nozzle 23, the plunger shaft 29, and the nut 25 (See FIG. 2.); (9) to provide a threaded interface with the annular wrench body fitting 28 (See FIG. 2.); (10) to provide a interface with nut 25 that precludes rotation of nut 25 to enable the nut 25 to climb the threads as at 36 (See FIGS. 19 and 28.).

The annular wrench body fitting 28 of the valve wrench assembly 20 has three basic functions: (1) to capture the threaded sleeve 26 through the mating internal thread 42 of the annular wrench body fitting 28 thereby enabling coaxial movement between the threaded sleeve 26 and the annular wrench body fitting 28 (See FIG. 2.); (2) to provide an o-ring groove 44 to capture the fitting-based o-ring 70 (See FIG. 23.); and (3) to provide accurate coaxial alignment between the valve wrench assembly 20 and the protrusion 32 of the shell of the valve 80 assembly (See FIGS. 48,48(*a, b, c*, and *d*).).

The fitting-based o-ring 70 has two basic functions: (1) to provide a highly deformable, elastic body; and (2) to provide interference between the opposing adjacent surfaces between container rim 10 of the aerosol can assembly 11 and the outside surface of the annular wrench body fitting 28 thereby establishing an attachment means between the aerosol can assembly 11 and the valve wrench assembly 20 (See FIG. 2.). This interference occurs subsequent to elastically deforming the fitting-based o-ring 70 and the elastic recovery of the fitting-based o-ring 70.

Figure 6:
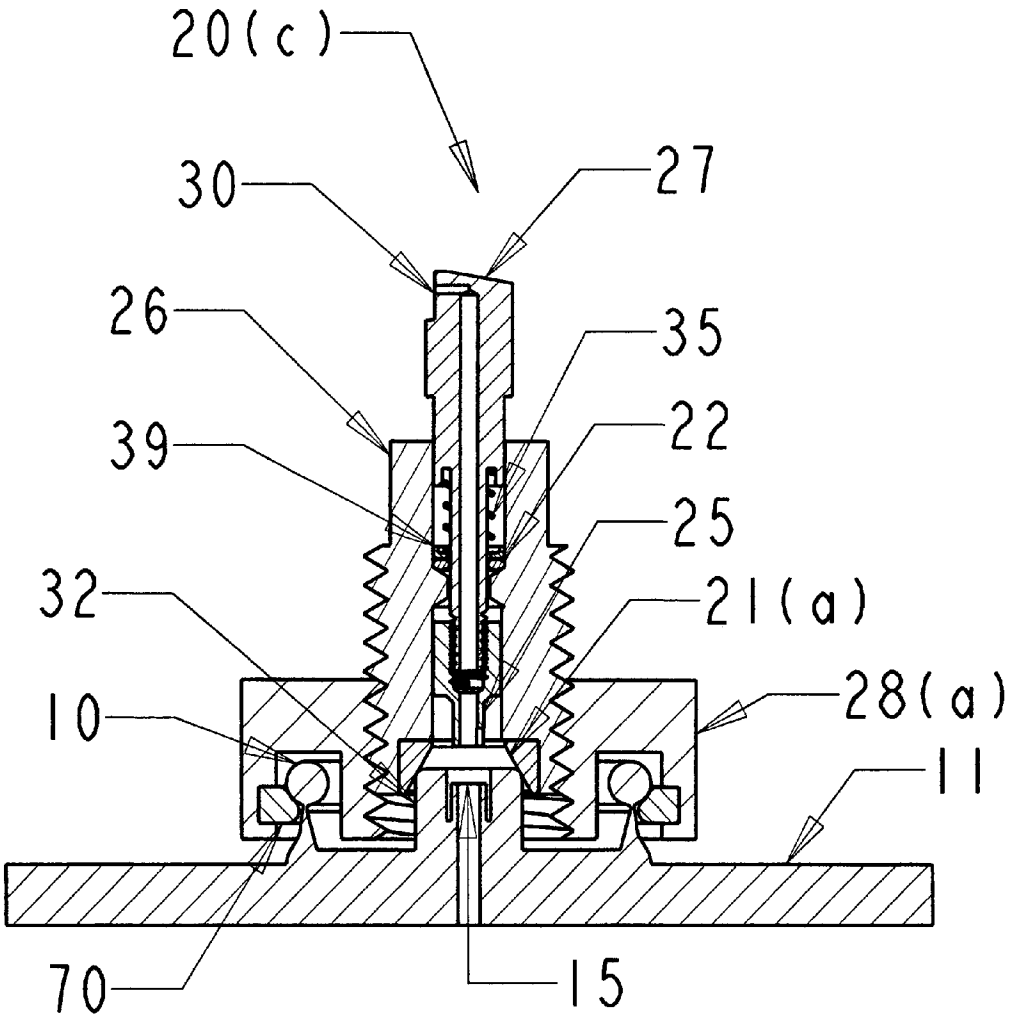
FIG. 6 is a cross sectional side view depiction of a fourth embodiment 20(*c*) of the valve wrench assembly kit according to the present invention otherwise depicted in FIG. 2 having a integral nozzle-shaft 23, an annular wrench body fitting 28(*a*) and an annular gasket 21(*a*) with sloped inner radial surfacing showing the valve wrench assembly attached to a standard/generic aerosol container at its upper container rim and showing the valve wrench assembly in a relaxed, non-activated state.

As may be understood from a consideration of illustrations referencing annular wrench body fitting 28(*a*), the annular wrench body fitting 28(*a*) and the fitting-based o-ring 70 are designed to provide interference between the opposing adjacent surfaces between the outside surface as at 46 of the container rim 10 of the aerosol can assembly 11 and the inside surface of the annular wrench body fitting 28(*a*) (See FIG. 6.). This interference occurs subsequent to elastically deforming the fitting-based o-ring 70 and the elastic recovery of the fitting-based o-ring 70.

The nut 25 has eight basic functions: (1) to provide means by which the plunger shaft 29 can be captured within the threaded sleeve 26 (See FIG. 2.). In this regard, it will be noted that the nut 25 comprises a larger diameter than the threaded sleeve hole 50(*a*), and thus the nut 25 cannot pass through the threaded sleeve hole 50(*a*) (See FIGS. 2 and 28.); (2) to provide means for simple interchange of the integral nozzle-shaft 27 (See FIG. 6.); and (3) to preclude the need for sealant between mating threads 36 and 52(*a*) since the nut 25 is upstream of the plunger-based o-ring 22 (See FIG. 2.).

Figure 3:
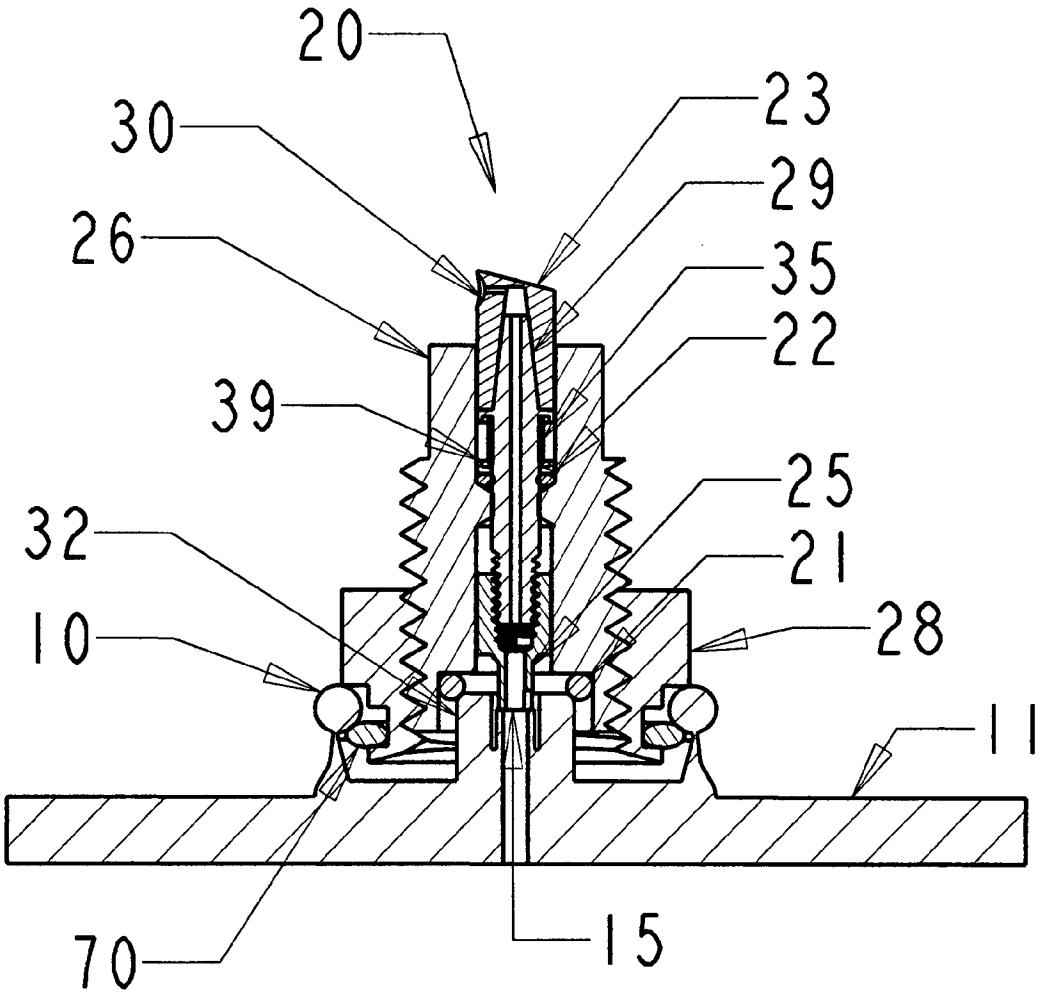
FIG. 3 is a cross sectional side view depiction of the first embodiment 20 of the valve wrench assembly kit otherwise depicted in FIG. 2 showing the valve wrench assembly in an activated state.

The nut 25 further functions (4) to provide the probe 25(*a*) by which the valve stem 18 of the valve 80 assembly is engaged and depressed (FIGS. 3 and 13.); (5) to provide means by which the penetration of the probe 25(*a*) can be adjusted thereby to accommodate variations in the depth of the valve stem 18 of the valve 80 assembly (See FIGS. 10, 11, and 13.), and/or (6) to accommodate accurate regulation of the discharge rate of the product from the aerosol can assembly 11; (7) to provide conduit 31(*b*) to the plunger shaft 29 for product discharged from the aerosol can assembly 11 (See FIG. 21.); and (8) to transmit the necessary force to open the valve 80 assembly of the aerosol can assembly 11 (See FIG. 3.).

The slot 31(*a*) in the end of the probe 25(*a*) of the nut 25 has one basic function: (1) to provide egress to the conduit 31(*b*) of the nut 25 should the entrance 31 of the probe 25(*a*) become blocked (See FIGS. 19 and 21.).

The flat 24 on the side of the nut 25 has one function: (1) to preclude, as consequence of its interface with flat 24(*a*) of the threaded sleeve 26, rotation of the nut 25 whenever the plunger shaft 29 is twisted (See FIGS. 2 and 19.).

The plunger shaft 29, has nine basic functions: (1) to provide the internal thread 52(*a*) of the nut 25 mating external threads 36 in order to attach the plunger shaft 29 to the nut 25 (See FIG. 2.); (2) to provide a sealing surface as at interfacing surface 36(*a*) for the plunger-based o-ring 22 (See FIG. 14.); and (3) to provide conduit 53 for the product of the aerosol container 11 to the nozzle 23 (See FIG. 14.).

The plunger shaft 29 further functions (4) to provide translational guidance and lateral support to spring 35 (See FIG. 2.); (5) to transmit the necessary force to open the valve 80 assembly (See FIG. 3.); (6) to provide a spring cup 36(*b*) for the spring 35 (See FIG. 14.); (7) to provide a capturing means for the non-integral nozzle 23 (See FIG. 2); (8) to provide a mating sealing tapered surface as at 38(*a*) that mates with a sealing tapered surface 38(*b*) of the nozzle 23 (See FIG. 14.); and (9) to provide a plunger-based o-ring 22 installation/removal tool. The external threads 36 of plunger shaft 29 element engage the plunger-based o-ring 22 sufficiently to enable the plunger shaft 29 to function as a plunger-based o-ring 22 installation/removal tool (See FIG. 14.).

The integral nozzle-shaft 27 has nine basic functions: (1) to provide the internal thread 52(*a*) of the nut 25 mating external threads 36 in order to attach the integral nozzle-shaft 27 to the nut 25 (See FIG. 15.); (2) to provide a sealing surface as at interfacing surface 36(*a*) of the integral nozzle-shaft 27 for the plunger-based o-ring 22 (See FIG. 15.); and (3) to provide conduit 53 for the product of the aerosol can assembly 11 to the outlet 30 of integral nozzle-shaft 27 (See FIG. 15.).

The integral nozzle-shaft 27 further functions (4) to provide translational guidance and lateral support to the spring 35 (See FIG. 6.); (5) to transmit the necessary force to open the valve 80 assembly (See FIG. 3, but imagine the integral nozzle-shaft 27 substituted for the plunger shaft 29 and nozzle 23.); (6) to provide a spring cup 36(*b*) for the spring 35 (See FIG. 15.); (7) to provide shaping egress as at outlet 30 for the discharge of the aerosol container's 11 product (See FIG. 15.); (8) to provide a lateral support point through its interface with the threaded sleeve 26 (See FIG. 6.); and (9) to provide a plunger-based o-ring 22 installation/removal tool. The external threads 36 of the integral nozzle-shaft 27 engage the plunger-based o-ring 22 sufficiently to enable the integral nozzle-shaft 27 to function as a plunger-based o-ring 22 installation/removal tool (See FIG. 15.).

The spring 35 has one basic function: (1) to provide the retraction force necessary to self-activate the retraction of the nozzle 23, the plunger shaft 29, and the nut 25 sub-assembly of the valve wrench assembly 20 upon release of the valve 80 assembly's opening force transmitted to the valve 80 assembly through the valve wrench assembly 20 (Compare FIGS. 2 and 3.).

The washer 39 has two basic functions: (1) to provide a flat bearing surface 39(*b*) for compressing the plunger-based o-ring 22 (See FIGS. 2 and 14.); and (2) to provide a spring cup 39(*a*) for the spring 35 (See FIGS. 2 and 14.).

The nozzle 23 has four basic functions: (1) to provide a means to capture the plunger shaft 29 (See FIGS. 2 and 14.); (2) to provide a mating sealing tapered surface 38(*b*) that mates with a sealing tapered surface 38(*a*) of the plunger shaft 29 (See FIGS. 2 and 14.); (3) to provide shaping egress as at outlet 30 for the discharge of the aerosol container's 11 product 13 (See FIG. 14.); and (4) to provide aiming guidance by its beveled top surface for product discharged from the aerosol container.

The annular gasket 21 has two basic functions: (1) to provide a seal between the threaded sleeve 26 of the valve wrench assembly 20 and the protrusion 32 of the shell of the valve 80 assembly (See FIGS. 3 and 36.); and (2) to provide means to align coaxially the probe 25(*a*) of the nut 25 and the valve stem 18 of the valve 80 assembly of the aerosol container 11 (See FIGS. 19, 49, 49(*a* and *b*).). In this last regard, it will be recalled that there are at least three potential annular gasket cross sections (as comparatively depicted in FIGS. 45(*a*), 46(*a*), and 47(*a*)) which may possibly be used depending on the situation.

The plunger-based o-ring 22 has two basic functions: (1) to provide a seal between the plunger shaft 29 and the threaded sleeve 26 of the valve wrench assembly 20 (See FIG. 2.); and (2) to provide a friction locking device to lock the penetration depth of the probe 25(*a*) of the nut 25 into the valve 80 assembly thereby to maintain accurate regulation of the discharge rate of the product 13 from the aerosol container 11 (See FIGS. 2, 8, and 19.).

The Spring Cup 36(*b*) has two basic functions: (1) to preclude interference with the valve wrench assembly's 20 action due to spring 35 rubbing against the interfacing surface 50(*b*) of the threaded sleeve 26 (See FIGS. 2, 14, and 28.), and (2) to permit, without affecting the stroke of the valve wrench assemblies, the spring 35 to be of different free lengths. This is provided for by adjusting the depth of the spring cup 36(*b*) of the plunger shaft 29. Thereby, springs of different solid heights can be accommodated to allow for adjustment of maximum spring force and to adjust the absolute maximum penetration depth of the probe 25(*a*) of the nut 25 into the valve 80 assembly.

The Spring Cup 39(*a*) has one basic function: (1) to preclude interference with the valve wrench assembly's 20 action due to the spring 35 rubbing against the interfacing surface 50(*b*) of the threaded sleeve 26 (See FIGS. 2, 14, and 28.).

While the above description contains much specificity, this specificity should not be construed as limitations on the scope of the invention, but rather as an exemplification of the invention. For example, it is contemplated that the present invention essentially provides a valve wrench assembly to restore the function of an aerosol container as purposed by the OEM and, thereby, to discharge an aerosol container product as purposed by the OEM, which assembly comprises certain attachment means (as may be exemplified by the annular wrench body fitting 28) for attaching certain replacement discharge means (as may be exemplified by the plunger assembly) to an aerosol container.

It is contemplated that said attachment means may be outfitted upon an aerosol container having a compromised, damaged, or broken container outlet, and that the replacement discharge means may be attached to the aerosol container adjacent the container outlet via the attachment means so as to discharge container products from the aerosol container via the compromised container outlet. The container products may thus be discharged both through the container outlet and said attachment means. The discharge means may further comprise axially displaceable structure, which axially displaceable structure may well function to depress the container outlet thereby discharging container products.

The present invention preferably thus provides a valve wrench assembly kit to restore a compromised aerosol container outlet, which aerosol container has an annular container rim and a container outlet. The valve wrench assembly kit comprises certain fastening means as exemplified by a container-to-assembly interface fitting as at 28 or as at 28(*a*) as well as a plunger assembly as previously described.

The plunger assembly essentially comprises a sleeve, a nut, and a plunger. The sleeve comprises nut-receiving and plunger-receiving cavities, which cavities are in communication with one another. The nut is received in the nut-receiving cavity and comprises a plunger-coupling cavity and a conduit inlet communicatively engageable with the container outlet. The plunger is received in the plunger-receiving and plunger-coupling cavities and comprises plunger-based conduit and a plunger outlet. The plunger is coupled to the nut thereby providing matter-conducting conduit from the conduit inlet to the conduit outlet. The sleeve is coupled to the through-hole for enabling matter to pass from the container outlet to the conduit outlet via the conduit inlet and plunger-based conduit.

Further, the foregoing specifications are believed to support certain methodology for discharging container products 13 from an aerosol container 11. In this regard, the present invention is believed to support an aerosol container products discharging method comprising the steps of: attaching an assembly such as the valve wrench assembly 20 to an aerosol can or container such as container 11 via the container rim 10 thereof, which valve 80 assembly comprises axially displaceable conduit as comparatively depicted in FIG. 2 (in which the plunger assembly is shown in a non-activated state with the conduit being shown in a first axial position) versus FIG. 3 (in which the plunger assembly is shown in an activated state with the conduit being shown in a second axial position relative to the first axial position).

The axially displaceable conduit is thereby communicatively engageable with a container outlet 15 of the aerosol container 11. Thus, when the conduit is axially displaced towards the container outlet 15 the action is designed to release container products 13 from the aerosol container 11 via the valve body 16 and container outlet 15, whereafter container products are directed through said conduit to an assembly outlet as at 30 of the valve wrench assembly 20 thereby discharging container products 13 from the aerosol container 11.

Figures 48, 48A, 48B, 48C, 48D:
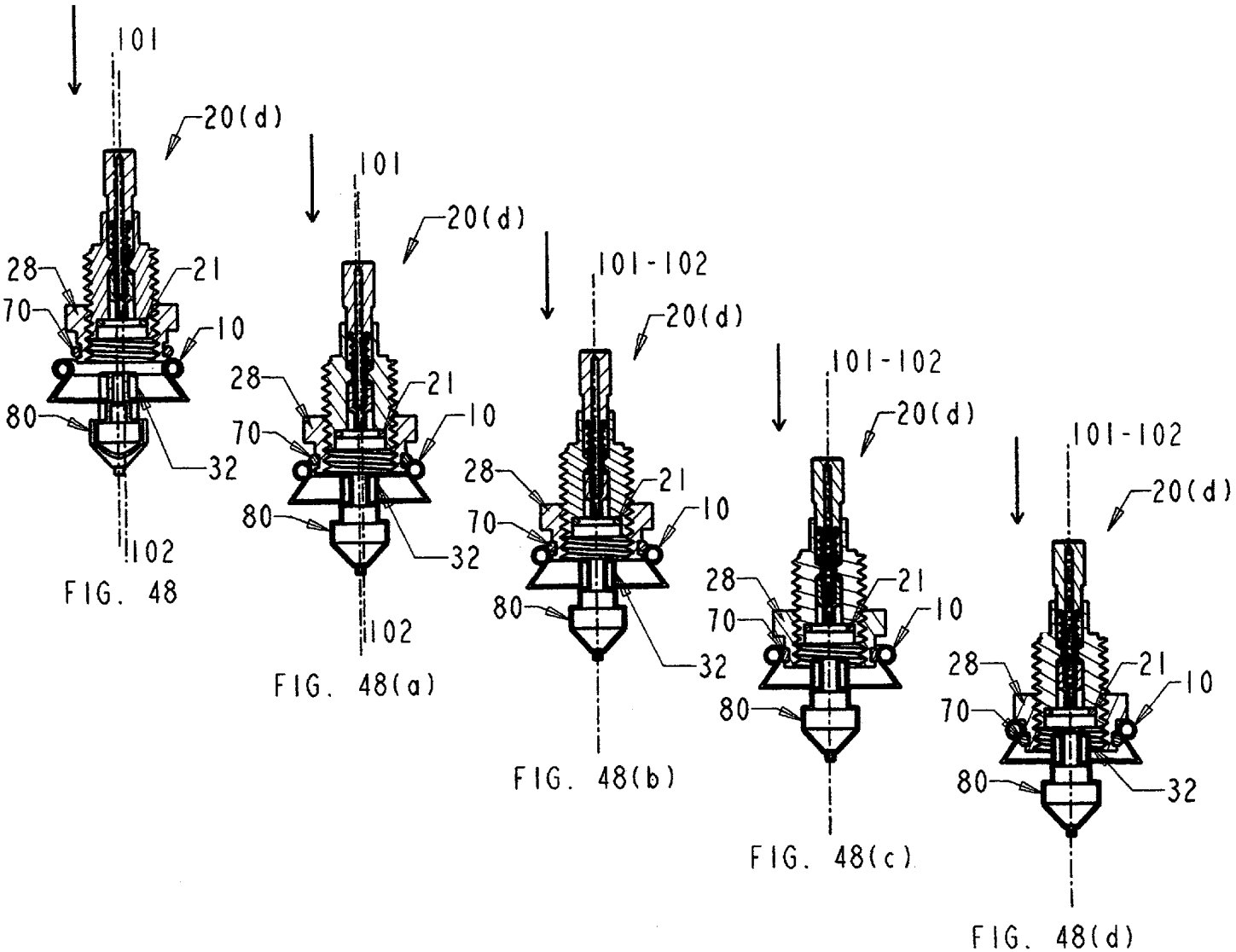
FIGS. 48, 48(*a*), 48(*b*), 48(*c*), and 48(*d*) are sequential cross sectional side view depictions showing the fifth embodiment 20(*d*) of the valve wrench assembly kit according to the present invention which illustrate the kinematics of preliminary axial alignment of axis 102 of its threaded sleeve 26 with axis 101 of the protrusion 32 of the shell of the valve 80 assembly of an aerosol container 11.

The method may be further defined such that the step of attaching the valve wrench assembly 20 to the container rim 10 of an aerosol can 11 may be said to comprise the step of slot-receiving the container rim 10 by the valve wrench assembly 20. In this regard imagine virtual material to be added to the outer most diameter of the annular wrench body fitting 28 which results in an annular wrench body fitting 28(*a*). The difference is only in the economy of material and the location of the o-ring receiving groove. Conceptually they are one and the same. Both annular wrench body fitting 28 and an annular wrench body fitting 28(*a*) slot-receive the container rim 10 and attach through interference via a deformed resilient o-ring. In other words, the container-to-interface fitting as at 28 slot-receives the container rim 10 as does the container-to-interface fitting as at 28(*a*) during the step of attaching the valve wrench assembly 20 to the aerosol container 11. Both, thereby, may be further defined such that the step of attaching the valve wrench assembly 20 to the container rim 10 of an aerosol can 11 axially align the conduit 53 relative to the container outlet 15 as generally depicted in FIGS. 48, 48(*a, b, c*, and *d*.).

As earlier set forth, at least one portion or a select portion of the valve wrench assembly 20 is interchangeable, the interchangeability of which enables the user to, among other acts, selectively manage the conduit or assembly outlet at 30. In this regard, it is contemplated that the nozzles 23 and/or the integral nozzle-shaft 27 may be interchanged for generalized maintenance and/or to alter the spray pattern as desired by the user.

As further mentioned hereinabove, the valve wrench assembly 20 may preferably comprise certain spring means for biasing the valve wrench assembly 20 to a non-activated position (as generally depicted in FIG. 2). In this regard, it is contemplated that the method may comprise the additional step of biasing the valve wrench assembly 20 conduit (as at 53) away from the container outlet 15 after directing container products 13 through said conduit 53. The spring means thus enable the user to selectively discharge container products 13 after attaching the valve wrench assembly 20 to the container rim 10.

Accordingly, although the invention has been described by reference to certain alternative embodiments, and certain methodology, it is not intended that the novel disclosures herein presented be limited thereby, but that modifications thereof are intended to be included as falling within the broad scope and spirit of the foregoing disclosure, the following claims and the appended drawings.

I claim:

1. A valve wrench assembly kit for directing aerosol can product discharge, the valve wrench assembly thereof comprising:

an interface fitting assembly, said fitting assembly comprising an annular fitting and a resiliently deformable o-ring, the annular fitting comprising an upper fitting section, a lower fitting section, and a threaded inner section extending through the upper and lower fitting sections, the upper fitting section for engaging an upper portion of an aerosol container rim, the upper fitting section having a first exterior diameter greater in magnitude than an inner rim diameter of said rim, the lower fitting section having a second and a third exterior diameter, the second exterior diameter being lesser than the first exterior diameter and inner rim diameter, the third exterior diameter being lesser than the second exterior diameter for defining a ring-receiving groove, the o-ring comprising an inner ring diameter and an outer ring diameter, the o-ring being received in the ring-receiving groove, the lower fitting section for positioning the o-ring as groove-received, against a lower portion of said rim, the outer ring diameter being greater than the second exterior diameter and the inner rim diameter when in a relaxed state, the outer ring diameter being resiliently deformable so as to enable the user to selectively and axially direct the o-ring past the inner rim diameter for securing the annular fitting to said rim; and a plunger assembly, the plunger assembly comprising a sleeve, a nut, and a plunger, the sleeve comprising axially opposed nut-receiving and plunger-receiving cavities, said cavities being in communication with one another via an aperture, the nut being received in the nut-receiving cavity and comprising a plunger-coupling cavity and a conduit inlet communicatively engageable with a container outlet on the aerosol container, the plunger being received in the plunger-receiving and plunger-coupling cavities and comprising a plunger conduit and an assembly outlet, the plunger being threadably coupled to the nut thereby providing matter-conducting conduit from the conduit inlet to the assembly outlet, the sleeve comprising external threads for threadably engaging the threaded inner section for enabling matter to pass from the container outlet to the assembly outlet via the conduit inlet and plunger conduit, the valve wrench assembly thusly for directing aerosol can product discharge.

2. The valve wrench assembly of claim 1 wherein the plunger assembly comprises spring means for biasing the plunger and nut to a non-activated position, said spring means thus enabling the user to selectively discharge container products.

3. The valve wrench assembly of claim 2 wherein the plunger assembly comprises o-ring gasket means for axially aligning the plunger assembly with an upwardly extending protrusion of the aerosol container thereby enhancing sealed and directed delivery of container products from the container outlet to the conduit outlet.

4. The valve wrench assembly of claim 3 wherein the plunger shaft is threadably attached to the nut, the site of threaded attachment being upstream from said o-ring gasket means thereby eliminating a thread sealant requirement.

5. The valve wrench assembly of claim 4 wherein the plunger-receiving cavity comprises ramped o-ring gasket seat structure, the o-ring ramped gasket seat structure for enhancing sealed and directed delivery of container products from the container outlet to the assembly outlet.

6. The valve wrench assembly of claim 5 wherein the sleeve comprises a nut-to-sleeve flat interface, the flat interface for preventing the nut from rotating relative to the sleeve.

7. The valve wrench assembly of claim 6 wherein the plunger comprises a shaft and at least one interchangeable nozzle, the shaft and at least one interchangeable nozzle being coupled to one another for enabling the user to selectively interchange one or more interchangeable nozzles for selectively shaping aerosol can product discharge.

8. The valve wrench assembly of claim 7 wherein the interface between the shaft and at least one interchangeable nozzle is tapered, the tapered interface for enhancing the seal intermediate the shaft and at least one interchangeable nozzle and for effecting a slip resistant interface.

9. A valve wrench assembly for directing aerosol can product discharge, the valve wrench assembly thereof comprising:

an interface fitting assembly, said fitting assembly comprising an annular fitting and a resiliently deformable o-ring, the annular fitting comprising an upper fitting section, a lower fitting section, and a threaded inner section extending through the upper and lower fitting sections, the upper fitting section for engaging an upper portion of an aerosol container rim, the upper fitting section having a first exterior diameter greater in magnitude than an outer rim diameter of said rim, the lower fitting section having a first and a second interior diameter, the first interior diameter being lesser than the first exterior diameter but greater that the outer run diameter, the second interior diameter being greater than the first interior diameter for defining a ring-receiving groove, the o-ring comprising an inner ring diameter and an outer ring diameter, the o-ring being received in the ring-receiving groove, the lower fitting section for positioning the o-ring as groove-received, against a lower portion of said rim, the outer ring diameter being less than the first exterior diameter but greater than the outer rim diameter when in a relaxed state, the inner ring diameter being resiliently deformable so as to enable the user to selectively and axially direct the o-ring past the outer rim diameter for securing the annular fitting to said rim; and a plunger assembly, the plunger assembly comprising a sleeve, a nut, and a plunger, the sleeve comprising axially opposed nut-receiving and plunger-receiving cavities, said cavities being in communication with one another via an aperture, the nut being received in the nut-receiving cavity and comprising a plunger-coupling cavity and a conduit inlet communicatively engageable with a container outlet on the aerosol container, the plunger being received in the plunger-receiving and plunger-coupling cavities and comprising a plunger conduit and an assembly outlet, the plunger being threadably coupled to the nut thereby providing matter-conducting conduit from the conduit inlet to the assembly outlet, the sleeve comprising external threads for threadably engaging the threaded inner section for enabling matter to pass from the container outlet to the assembly outlet via the conduit inlet and plunger conduit, the valve wrench assembly thusly for directing aerosol can product discharge.

10. The valve wrench assembly of claim 9 wherein the plunger assembly comprises spring means for biasing the plunger and nut to a non-activated position, said spring means thus enabling the user to selectively discharge container products.

11. The valve wrench assembly of claim 10 wherein the plunger assembly comprises o-ring gasket means for axially aligning the plunger assembly with an upwardly extending protrusion of the aerosol container thereby enhancing sealed and directed delivery of container products from the container outlet to the conduit outlet.

12. The valve wrench assembly of claim 11 wherein the plunger shaft is threadably attached to the nut, the site of threaded attachment being upstream from said o-ring gasket means thereby eliminating a thread sealant requirement.

13. The valve wrench assembly of claim 12 wherein the plunger-receiving cavity comprises ramped o-ring gasket seat structure, the o-ring ramped gasket seat structure for enhancing sealed and directed delivery of container products from the container outlet to the assembly outlet.

14. The valve wrench assembly of claim 13 wherein the sleeve comprises a nut-to-sleeve flat interface, the flat interface for preventing the nut from rotating relative to the sleeve.

15. The valve wrench assembly of claim 14 wherein the plunger comprises a shaft and at least one interchangeable nozzle, the shaft and at least one interchangeable nozzle being coupled to one another for enabling the user to selectively interchange one or more interchangeable nozzles for selectively shaping aerosol can product discharge.

16. The valve wrench assembly of claim 15 wherein the interface between the shaft and at least one interchangeable nozzle is tapered, the tapered interface for enhancing the seal intermediate the shaft and at least one interchangeable nozzle and for effecting a slip resistant interface.

17. A valve wrench assembly for directing aerosol can product discharge, the valve wrench assembly comprising:

an interface fitting assembly, said fitting assembly comprising a fitting and resiliently deformable diametric structure, the fitting comprising an upper fitting section, a lower fitting section, and a threaded inner section having a fitting axis, the upper fitting section being seatable upon an upper portion of an aerosol container rim, the lower fitting section cooperably positioning said diametric structure concentric about the fitting axis, the diametric structure being resiliently deformable so as to enable the user to selectively and axially direct the diametric structure past a select rim diameter for securing the fitting to said rim; and a plunger assembly, the plunger assembly comprising a sleeve, a nut, and a plunger, the sleeve comprising axially opposed nut-receiving and plunger-receiving cavities, said cavities being in communication with one another via an aperture, the nut being received in the nut-receiving cavity and comprising a plunger-coupling cavity and a conduit inlet communicatively engageable with a container outlet on the aerosol container, the plunger being received in the plunger-receiving and plunger-coupling cavities and comprising a plunger conduit and an assembly outlet, the plunger being threadably coupled to the nut thereby providing matter-conducting conduit from the conduit inlet to the assembly outlet, the sleeve comprising external threads for threadably engaging the threaded inner section for enabling matter to pass from the container outlet to the assembly outlet via the conduit inlet and plunger conduit, the valve wrench assembly thusly for directing aerosol can product discharge.

18. The valve wrench assembly of claim 17 wherein the plunger assembly comprises o-ring gasket means for axially aligning the plunger assembly with an upwardly extending protrusion of the aerosol container thereby enhancing sealed and directed delivery of container products from the container outlet to the conduit outlet.

19. The valve wrench assembly of claim 18 wherein the plunger shaft is threadably attached to the nut, the site of threaded attachment being upstream from said o-ring gasket means thereby eliminating a thread sealant requirement.

20. The valve wrench assembly of claim 17 wherein the plunger-receiving cavity comprises ramped gasket seat structure, the ramped gasket seat structure for enhancing sealed and directed delivery of container products from the container outlet to the assembly outlet.

21. The valve wrench assembly of claim 17 wherein the sleeve comprises a nut-to-sleeve flat interface, the flat interface for preventing the nut from rotating relative to the sleeve.

22. The valve wrench assembly of claim 17 wherein the plunger comprises a shaft and at least one interchangeable nozzle, the shaft and at least one interchangeable nozzle being coupled to one another for enabling the user to selectively interchange one or more interchangeable nozzles for selectively shaping aerosol can product discharge.

23. The valve wrench assembly of claim 22 wherein the interface between the shaft and at least one interchangeable nozzle is tapered, the tapered interface for enhancing the seal intermediate the shaft and at least one interchangeable nozzle and for effecting a slip resistant interface.

24. The valve wrench assembly of claim 17 wherein the plunger assembly is threadably adjustable relative to the fitting assembly for selectively adjusting the aerosol can product discharge rate.

* * * * *